US010429136B2

(12) United States Patent
Coller et al.

(10) Patent No.: US 10,429,136 B2
(45) Date of Patent: Oct. 1, 2019

(54) OUTBOARD MARINE PROPULSION SYSTEM WITH CLOSED LOOP LOWER UNIT HEAT EXCHANGER

(71) Applicant: Global Packaging Systems, LLC, Victor, NY (US)

(72) Inventors: Thomas Charles Coller, Honeoye Falls, NY (US); Steven Donald Bush, Red Creek, NY (US)

(73) Assignee: Global Packaging Systems, LLC, Victor, NY (US)

( * ) Notice: Subject to any disclaimer, the term of this patent is extended or adjusted under 35 U.S.C. 154(b) by 0 days.

(21) Appl. No.: 15/912,500

(22) Filed: Mar. 5, 2018

(65) Prior Publication Data

US 2019/0271508 A1 Sep. 5, 2019

(51) Int. Cl.
*B63H 20/28* (2006.01)
*F28D 7/16* (2006.01)

(52) U.S. Cl.
CPC ..... *F28D 7/1669* (2013.01); *B63H 20/28* (2013.01)

(58) Field of Classification Search
CPC ..... F28D 7/1669; B63H 20/28
See application file for complete search history.

(56) References Cited

U.S. PATENT DOCUMENTS 2,886,462 A * 5/1959 Jagiel ..... B63H 20/08 114/285
3,240,181 A * 3/1966 Chandler ..... B63H 20/285 440/78
3,650,310 A * 3/1972 Childress ..... B63B 39/061 114/286
4,220,121 A 9/1980 Maggiorana
4,306,614 A 12/1981 Maggiorana
4,759,181 A 7/1988 Biritz
4,991,546 A 2/1991 Yoshimura
5,004,042 A 4/1991 McMorries, IV et al.
5,746,270 A 5/1998 Schroeder et al.
7,094,118 B1 8/2006 Phillips et al.
7,264,520 B1 9/2007 Taylor et al.
7,503,819 B1 3/2009 Jaeger et al.
9,004,961 B1 4/2015 French et al.
9,545,985 B1 * 1/2017 Provost ..... B63H 20/28
9,580,159 B1 2/2017 Provost
9,815,539 B1 11/2017 Provost
9,834,291 B2 12/2017 Davis et al.
2004/0231648 A1 11/2004 Katayama
2016/0129981 A1 5/2016 Davis et al.
2017/0259896 A1 9/2017 Davis et al.

* cited by examiner

*Primary Examiner* — Stephen P Avila
(74) *Attorney, Agent, or Firm* — Patent Technologies, LLC; Robert D. Gunderman, Jr.

(57) ABSTRACT

An outboard marine propulsion system with a closed loop lower unit heat exchanger is described. The closed loop lower unit heat exchanger provides improved cooling to outboard marine propulsion units and increases engine life compared with traditional open loop cooling systems, particularly in harsh environments such as salt water, brackish water, swamp, shallow or sediment and debris rich water. The closed loop lower unit heat exchanger also provides improved performance to the outboard marine propulsion system when mounted to an appropriate portion of the lower unit of the outboard marine engine such as the anti-cavitation plate.

14 Claims, 46 Drawing Sheets

OUTBOARD MARINE PROPULSION SYSTEM WITH CLOSED LOOP LOWER UNIT HEAT EXCHANGER

CROSS REFERENCE TO RELATED PATENT APPLICATIONS

BACKGROUND OF THE INVENTION

1. Field of the Invention

The present invention relates generally to propulsion systems for marine vessels, and more particularly to an outboard marine propulsion system with a closed loop lower unit heat exchanger and the various components thereof.

2. Description of the Related Art

Outboard motors that are manufactured today use an open loop cooling system where water is drawn from the marine operating environment into the outboard motor for cooling purposes. The water is passed through the engine, oil cooler, fuel cooling system, and exhaust and then returned to the marine operating environment. Such an open loop cooling system is both efficient and cost effective, but there are some drawbacks to an open loop cooling system that can result in not only performance issues, but early engine failure.

An open loop cooling system can lead to the plugging of internal engine passages through debris such as mud, stones, weeds, leaves, and the like, all of which can be drawn in with the intake water used for cooling. In addition, when an outboard motor with such an open loop cooling system is operated in salt water, the untreated cast aluminum cooling channels inside the outboard motor will oxidize over time. Small water channels within the outboard motor will become plugged with aluminum oxide that breaks free from oxidized areas within the engine, plugging those cooling channels and causing the engine to run hot or overheat and eventually fail. While aluminum is less corrosive than steel and iron products, it will still oxidize and eventually fail over time. Plugged water channels may cause an engine to overheat with resulting damage. In some cases, the oxidation may be so severe that the internal walls of the motor become porous such that cooling water enters the combustion side of the engine, causing engine failure and the need for engine replacement, a costly proposition.

While outboard motor manufacturers use a plastic intake screen to prevent large solids from being drawn into the engine through the open loop cooling system, overheating will occur when the plastic screen is covered with debris such as weeds, leaves, and the like. Once the intake screen is covered with debris, water flow to the engine stops, leading to engine overheating and at a minimum the destruction of the water pump impeller within the engine.

What is needed is a closed loop cooling system for an outboard motor. What is further needed is a closed loop cooling system for an outboard motor that allows a traditional marine outboard motor to be converted into a closed loop cooling system.

It is thus an object of the present invention to provide such a closed loop cooling system and also provide for such a marine propulsion unit, as will be further described herein. These and other objects of the present invention are not to be considered comprehensive or exhaustive, but rather, exemplary of objects that may be ascertained after reading this specification and claims with the accompanying drawings.

BRIEF SUMMARY OF THE INVENTION

In accordance with the present invention, there is provided an outboard marine propulsion system with a closed loop lower unit heat exchanger as well as a closed loop lower unit heat exchanger for a marine propulsion system such as an outboard motor. A kit for converting an existing outboard motor to an outboard motor with a closed loop cooling system is also provided.

The foregoing paragraph has been provided by way of introduction, and is not intended to limit the scope of the invention as described by this specification, claims and the attached drawings.

BRIEF DESCRIPTION OF THE DRAWINGS

The invention will be described by reference to the following drawings, in which like numerals refer to like elements, and in which.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by this specification, claims, and drawings attached hereto.

DESCRIPTION OF THE PREFERRED EMBODIMENTS

The closed loop lower unit heat exchanger of the present invention will be described by way of example with several embodiments. These embodiments are to be representative examples of the present invention, and not limitations thereof. The closed loop lower unit heat exchanger of the present invention allows for retrofit or modification of an existing outboard motor as well as a complete overall outboard marine propulsion system that comprises the closed loop lower unit heat exchanger of the present invention; such an outboard marine propulsion system being considered an embodiment or embodiments of the present invention as described and depicted herein. The various constituent components of the present invention may be provided individually, as a complete unit or system, or in a kit or component form. The descriptions of each of these constituent components and their interaction and elements thereof being further described as follows.

FIGS. 1-35 depict a first embodiment of the present invention. While the lower unit heat exchanger is depicted with an outboard marine propulsion system, a full appreciation of the present invention and the various embodiments described, depicted and envisioned herein requires an understanding of the entire cooling system of the marine propulsion system and the way in which the lower unit heat exchanger interacts with the cooling system and the way in which that cooling system is modified to support the lower unit heat exchanger described herein.

Figure 1:
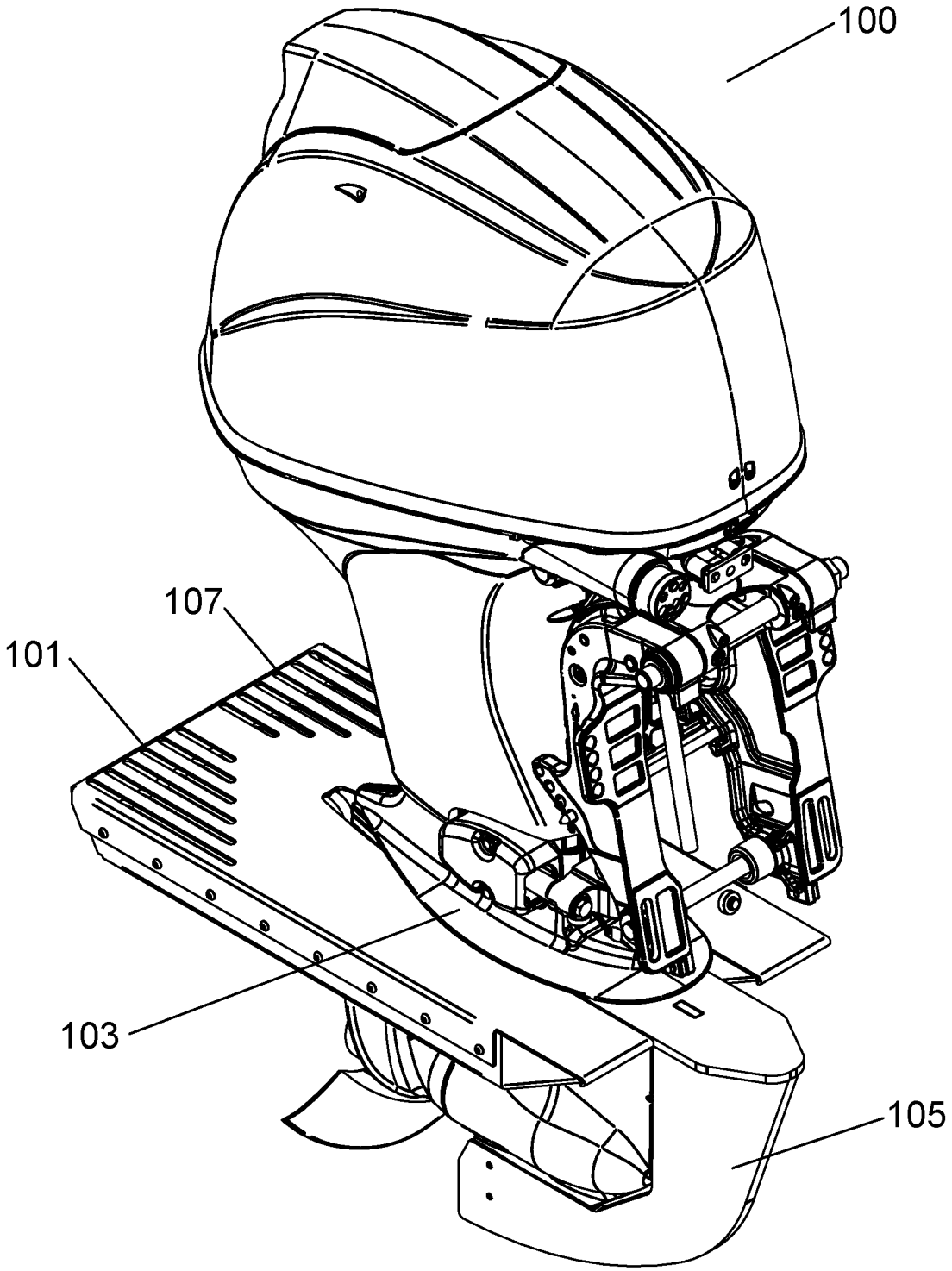
FIG. 1 is a perspective view of an outboard marine propulsion system fitted with a lower unit heat exchanger of the present invention.

FIG. 1 depicts a perspective view of an outboard marine propulsion system 100 fitted with a lower unit heat exchanger 101 of the present invention. As will be further described herein, the lower unit heat exchanger 101 attaches in a generally horizontal plane to the anti-cavitation plate 103 of an outboard marine propulsion system (an outboard motor). An optional front guard assembly 105 can also be seen in FIG. 1, providing protection to the lower unit heat exchanger 101 and the lower unit overall. The front guard assembly 105 is made of a material that can withstand impact, for example a metal as aluminum, steel, or the like. In some embodiments of the present invention, the front guard assembly 105 or the lower unit heat exchanger contains a sacrificial metal such as magnesium that prevents corrosion of the lower unit heat exchanger. The lower unit heat exchanger 101 can be seen in FIG. 1 with upper cooling slots 107 to provide marine water circulation around the cooling coil(s) contained within the housing.

Figure 2:
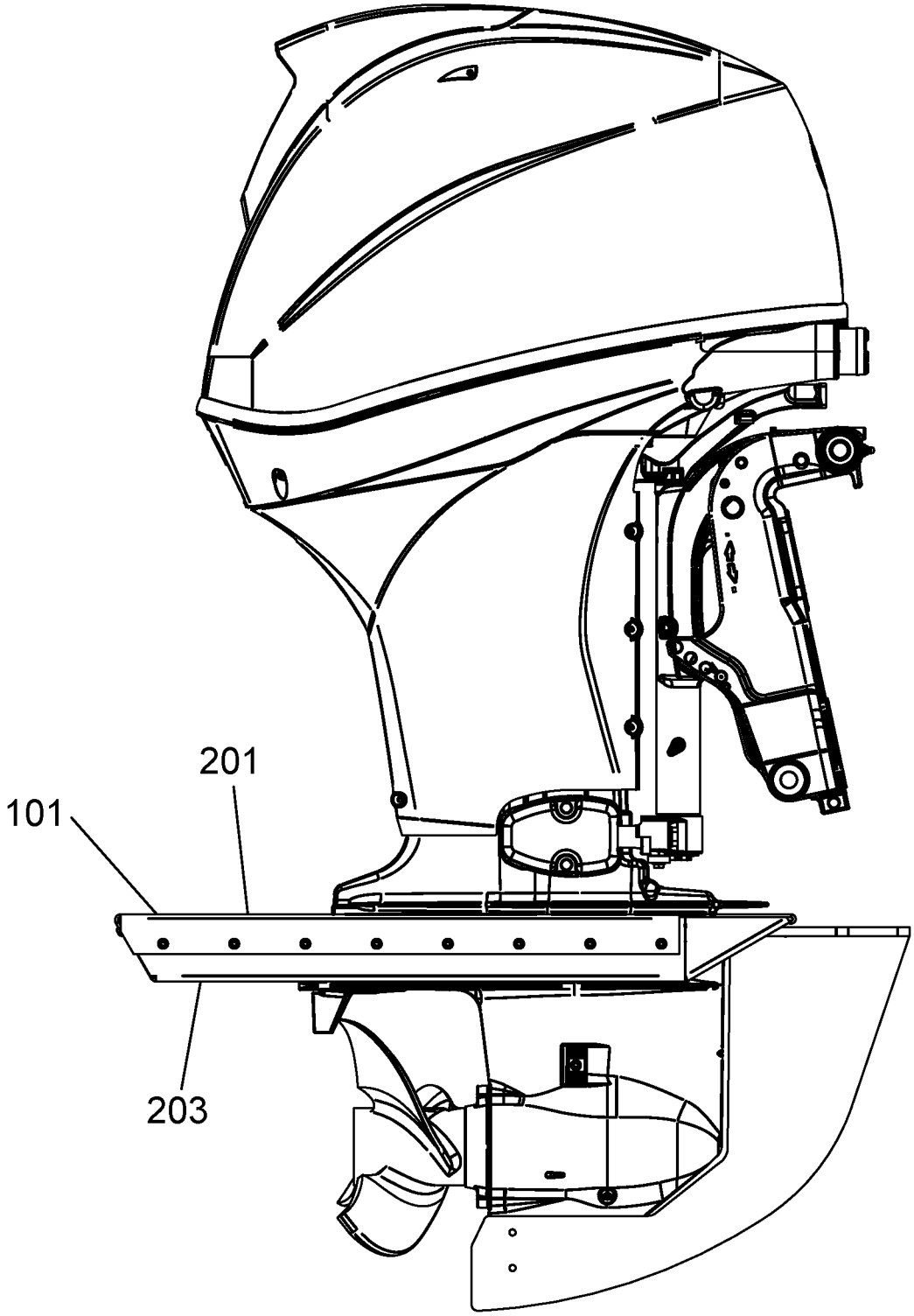
FIG. 2 is a side view of the outboard marine propulsion system and lower unit heat exchanger of FIG. 1.

FIG. 2 is a side view of the outboard marine propulsion system 100 and lower unit heat exchanger 101. The lower unit heat exchanger 101 comprises a housing having an upper half 201 and a lower half 203. The horizontal mounting of the lower unit heat exchanger 101 to the anti-cavitation plate of the outboard marine propulsion system can be clearly seen. This mounting configuration not only maximizes marine water flow and heat transfer during operation of the outboard motor, but also provides improved marine performance in the areas of boat stability, low speed operation and planing, and the like.

Figure 3:
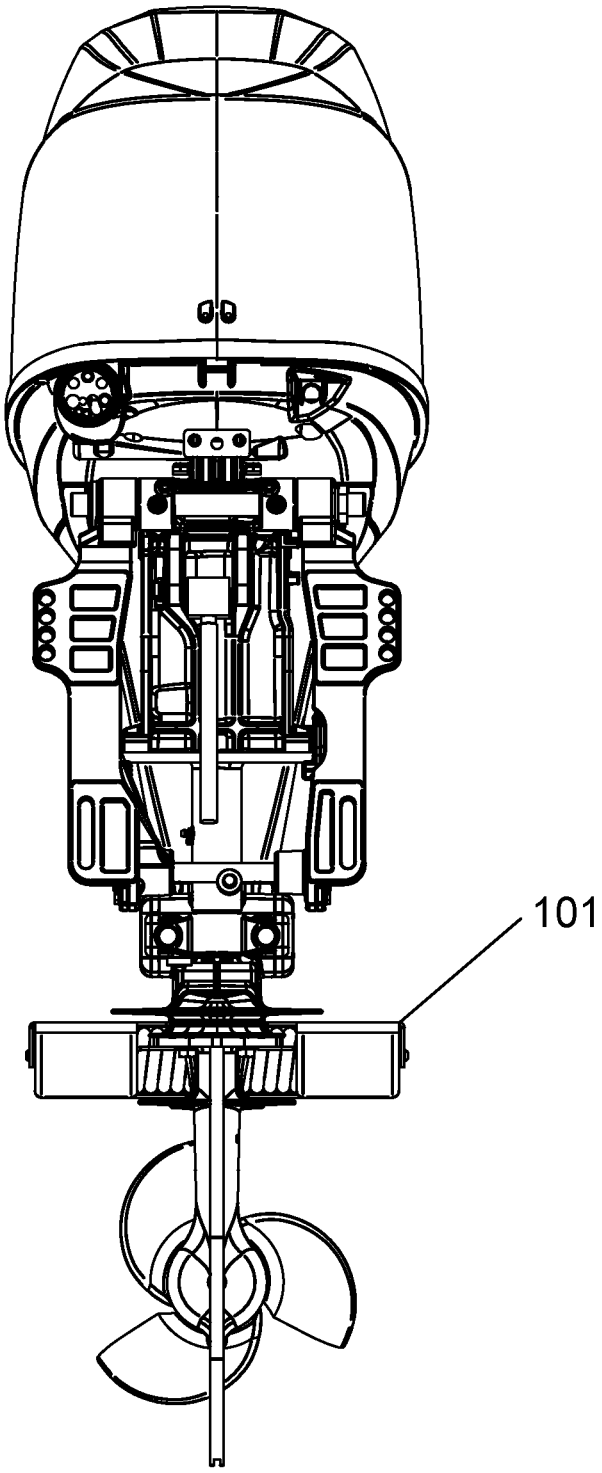
FIG. 3 is a front facing view of the outboard marine propulsion system and lower unit heat exchanger of FIG. 1.

FIG. 3 is a front facing view of the outboard marine propulsion system and lower unit heat exchanger 100. The cooling coil can be seen where the housing is open, allowing marine water flow through the lower unit heat exchanger during operation. The cooling coil will be further described by way of subsequent figures.

Figure 4:
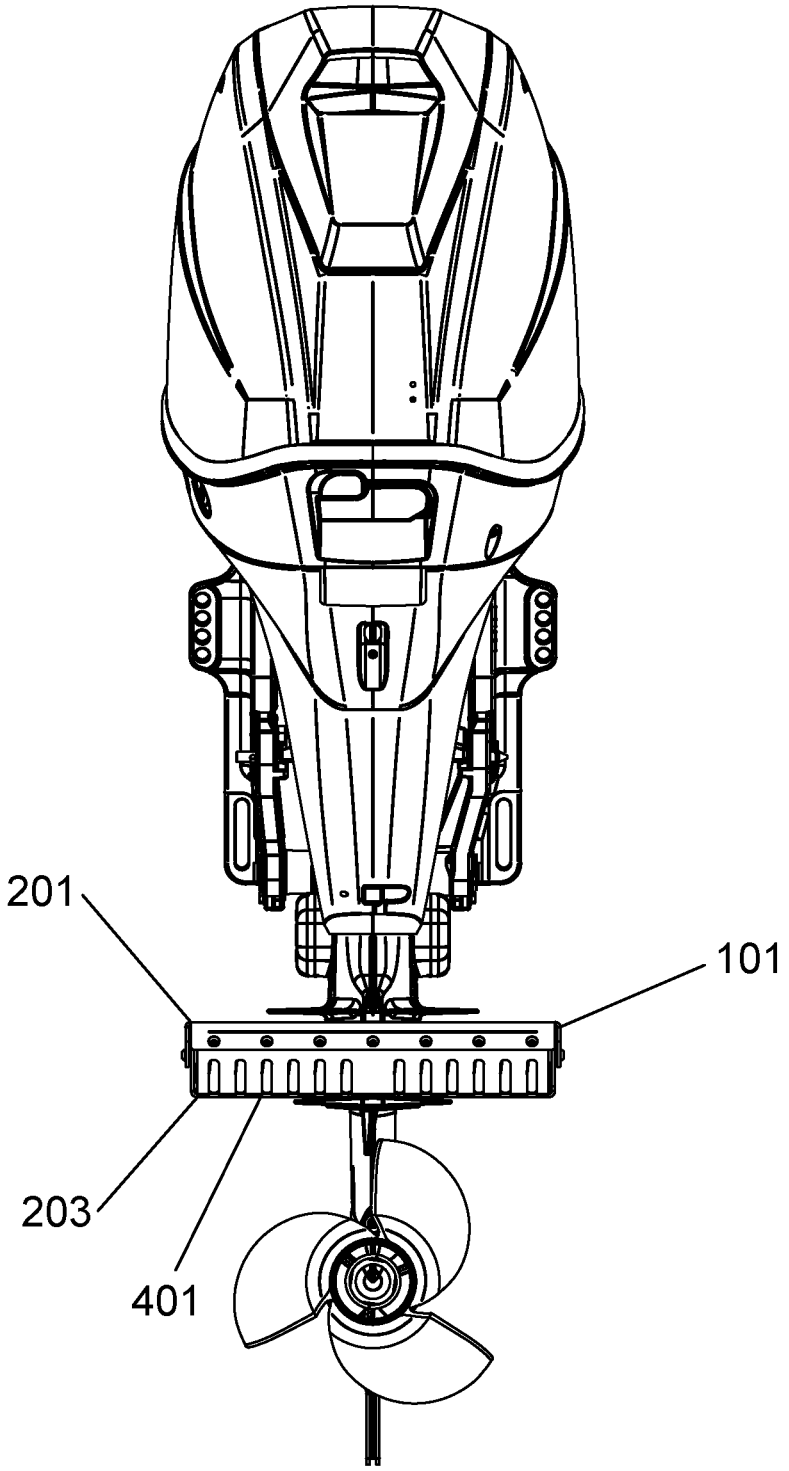
FIG. 4 is a rear facing view of the outboard marine propulsion system and lower unit heat exchanger of FIG. 1.

FIG. 4 is a rear facing view of the outboard marine propulsion system and lower unit heat exchanger 101 showing the joining of the housing upper half 201 and the housing lower half 203 along with lower cooling slots 401 contained in the housing lower half. These lower cooling slots 401 allow for the exit of marine water during operation. The marine water moves past the internal cooling coil during boat operation, facilitating heat transfer and removal of heat from the internal cooling coil.

Figure 5:
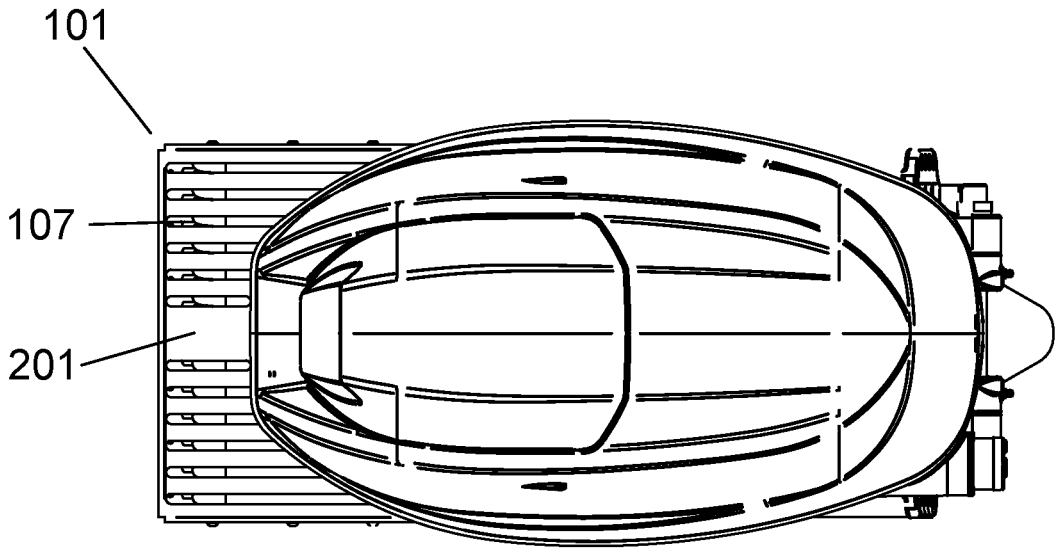
FIG. 5 is a top plan view of the outboard marine propulsion system and lower unit heat exchanger of FIG. 1.

FIG. 5 is a top plan view of the outboard marine propulsion system and lower unit heat exchanger 101 showing clearly the housing upper half 201 with upper cooling slots 107.

Figure 6:
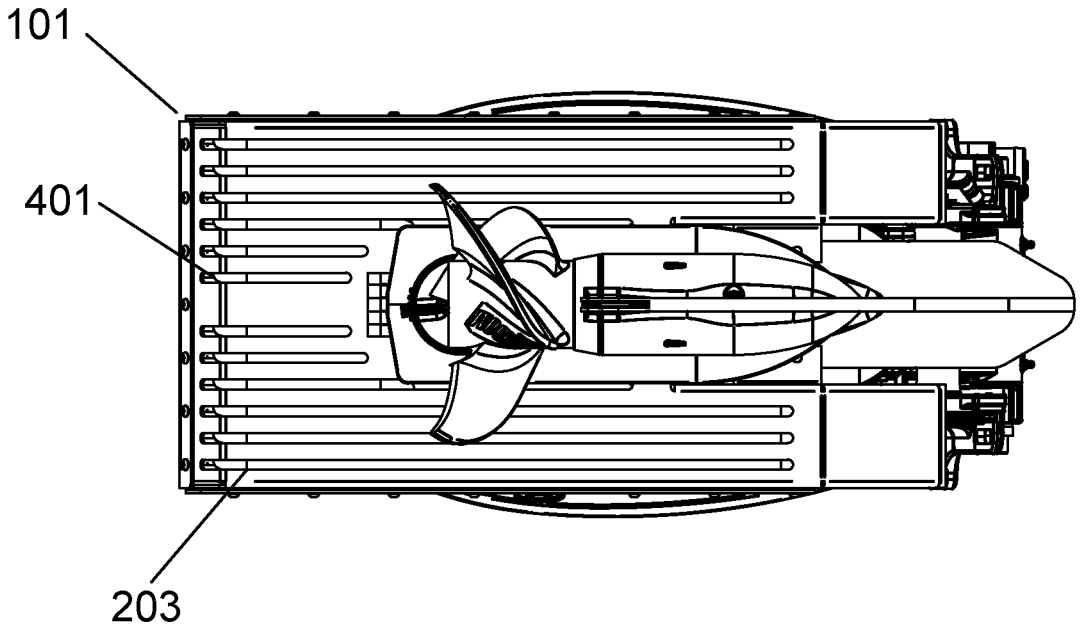
FIG. 6 is a bottom plan view of the outboard marine propulsion system and lower unit heat exchanger of FIG. 1.

FIG. 6 is a bottom plan view of the outboard marine propulsion system and lower unit heat exchanger 101 where the housing lower half 203 with lower cooling slots 401 can be seen. The lower cooling slots 401 as seen in FIG. 6 run longitudinal to the lower unit heat exchanger 101, as do the upper cooling slots 107 of the housing upper half 201.

Figure 7:
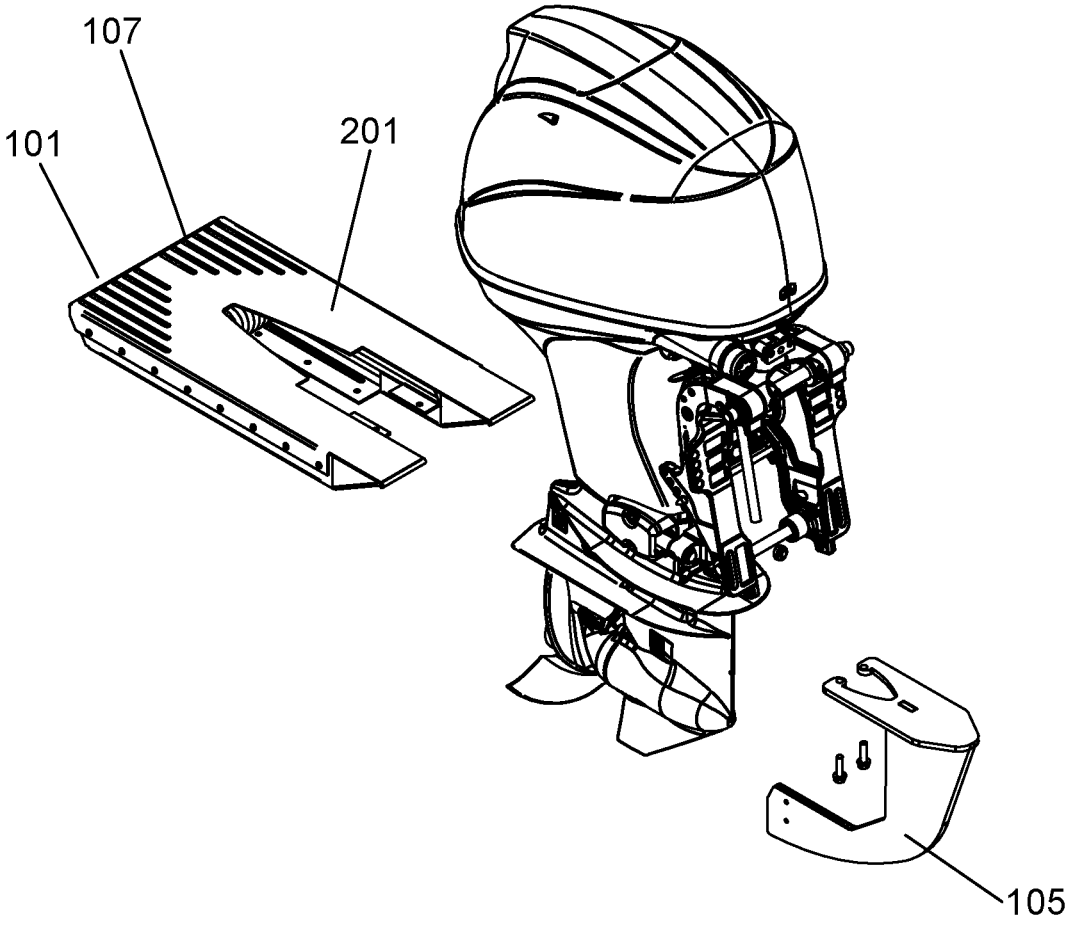
FIG. 7 is an exploded perspective view of the outboard marine propulsion system and lower unit heat exchanger of FIG. 1.

FIG. 7 is an exploded perspective view of the outboard marine propulsion system and lower unit heat exchanger 101 showing the way in which the lower unit heat exchanger 101 is attached to the outboard marine propulsion system. The front guard assembly 105 can also be seen.

Figure 8:
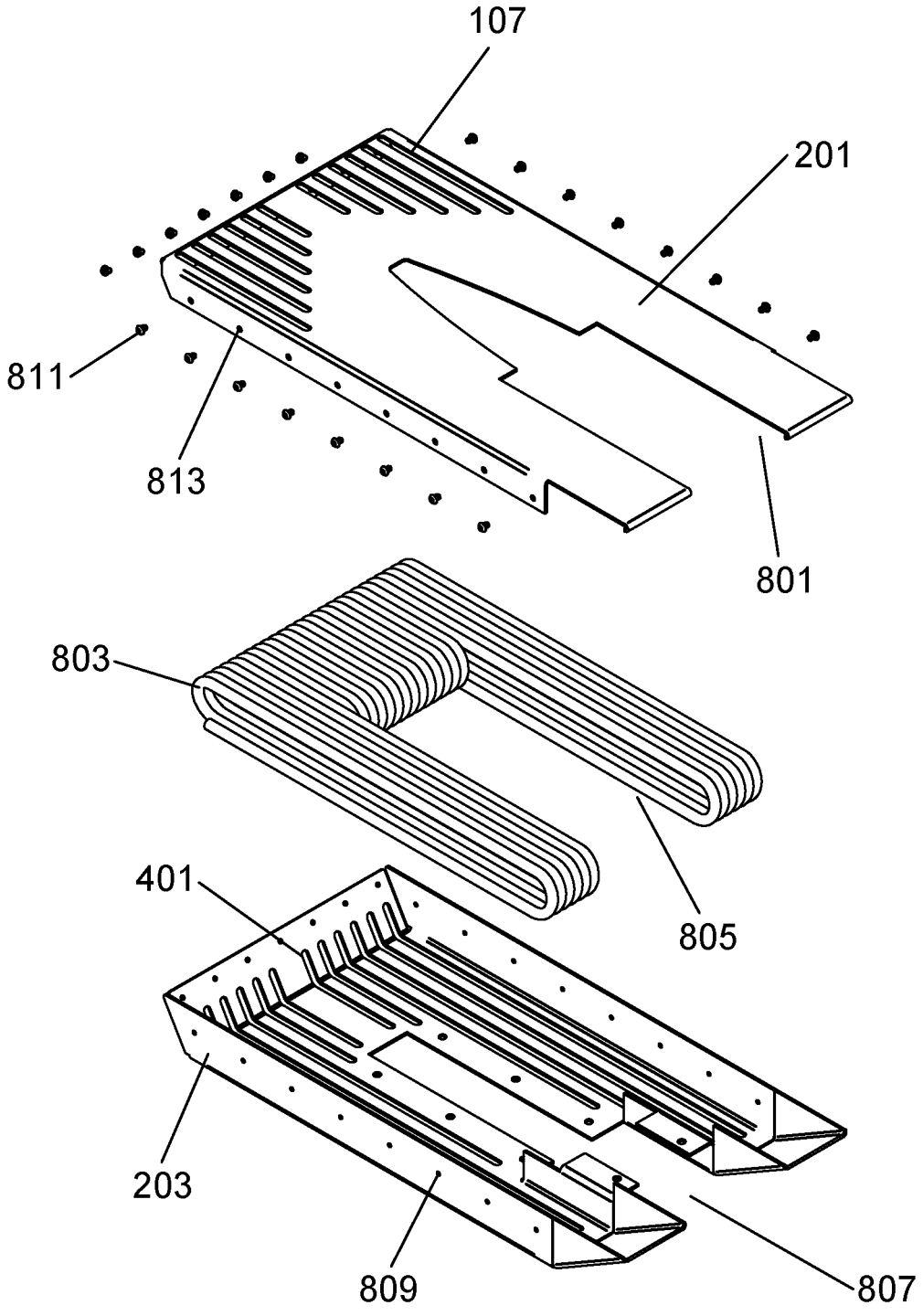
FIG. 8 is an exploded view of the lower unit heat exchanger of FIG. 1.

FIG. 8 is an exploded view of the lower unit heat exchanger 101 that shows the housing comprising an upper half 201 and a lower half 203 and containing a cooling coil 803 disposed within the housing when assembled. The cooling coil 803 is made from tubing or other conduit or passageway for the flow of coolant or cooling fluid. The tubing may be, for example, aluminum tubing to provide for good heat transfer from the coolant to the surrounding marine environment. To accommodate the lower unit, the cooling coil is configured with a middle section that is shorter than each side section, and may be, for example in a U-shaped configuration. Each side of the cooling coil 803 is in fluid communication with the cooling system of the outboard marine propulsion system, as further described herein. The housing upper half 201 and the housing lower half 203 are made of a durable material such as aluminum, steel, brass, or the like. The upper half of the housing 201 has upper cooling slots 107 as previously described and a lower unit opening 801 as depicted. To join the upper half housing 201 and the lower half housing 203 fastener holes 813 along the sides can be seen along with fasteners 811. The lower half housing 203 also has lower cooling slots 401 as previously described and a lower unit opening 807 as depicted. Fastener holes 809 can be seen along the sides. A leading edge taper (see FIG. 11) can be seen on the lower half housing 203 as well as mounting tabs (clearly seen in FIG. 9). The cooling coil 803 rests between the lower half housing 203 and the upper half housing 201 and is mechanically retained when the two halves arc assembled.

Figure 9:
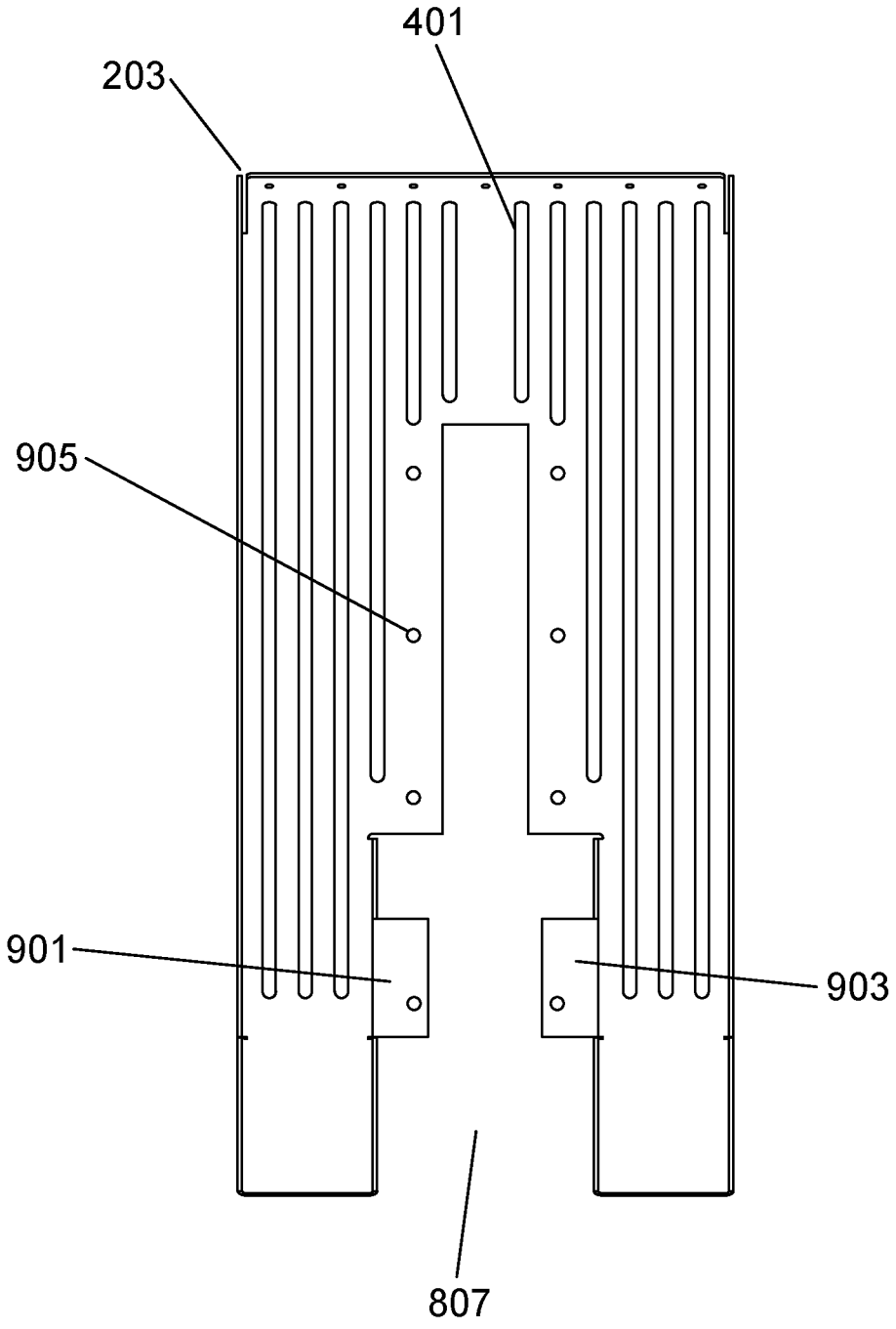
FIG. 9 is an outside plan view of the housing lower half of the lower unit heat exchanger of FIG. 8.

FIG. 9 is an outside plan view of the housing lower half of the lower unit heat exchanger of FIG. 8. Protruding into the lower unit opening 807 are a first mounting tab 901 and a second mounting tab 903. The mounting tabs and the lower half housing 203 also contain holes to facilitate mounting of the lower unit heat exchanger on the outboard marine propulsion system typically by horizontally attaching the lower unit heat exchanger to the anti-cavitation plate of the outboard motor, as seen in FIG. 1. The mounting tabs are co-planar with the lower unit heat exchanger. Cooling slots 401 longitudinally traverse the lower half housing 203 seen in FIG. 9 and as previously described herein.

Figure 10:
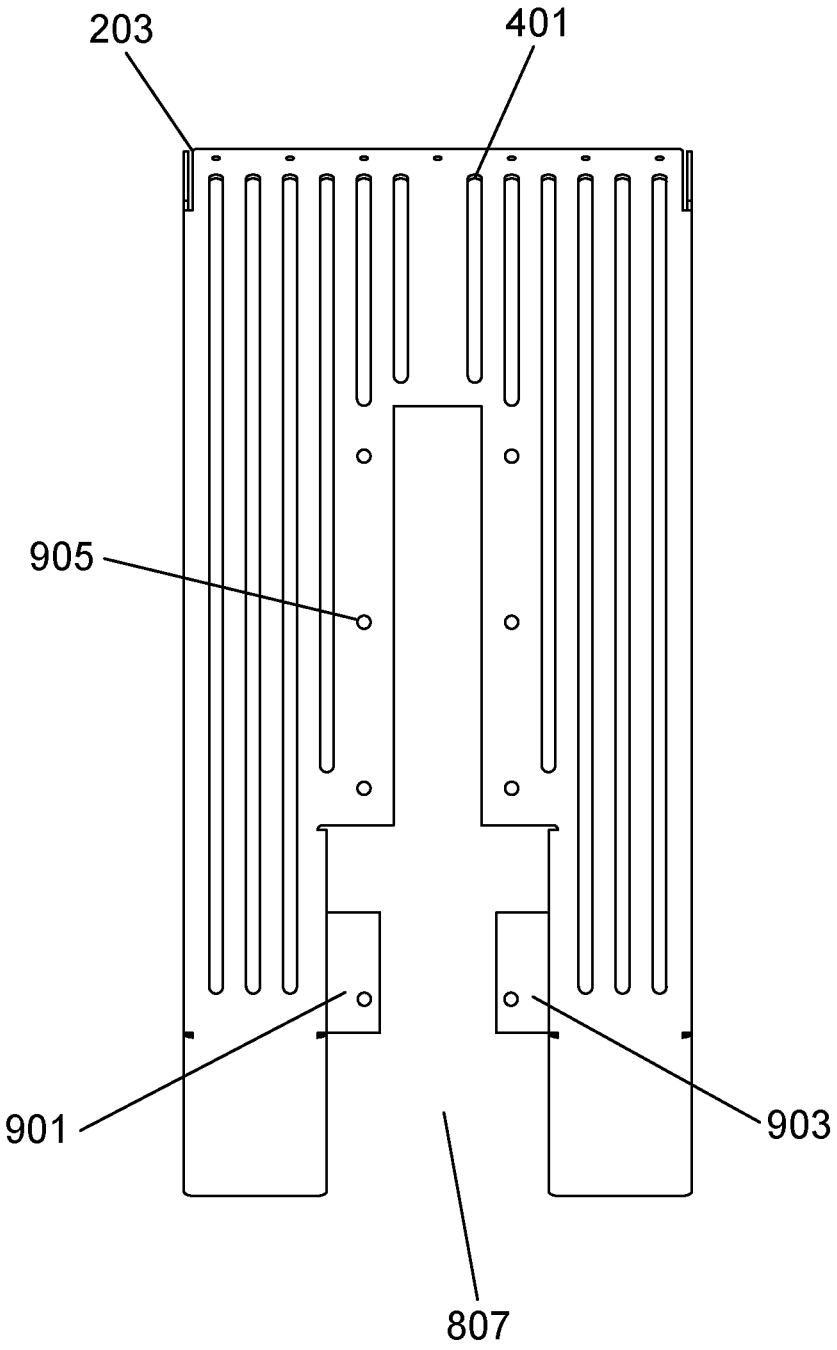
FIG. 10 is an inside plan view of the housing lower half of the lower unit heat exchanger of FIG. 8.

FIG. 10 is an inside plan view of the housing lower half of the lower unit heat exchanger of FIG. 8.

Figure 11:
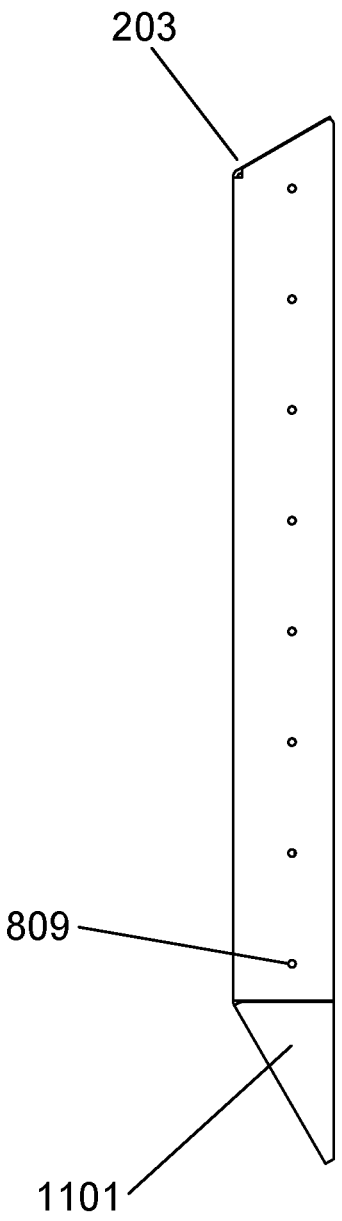
FIG. 11 is a side view of the lower unit heat exchanger of FIG. 8.
Figure 12:
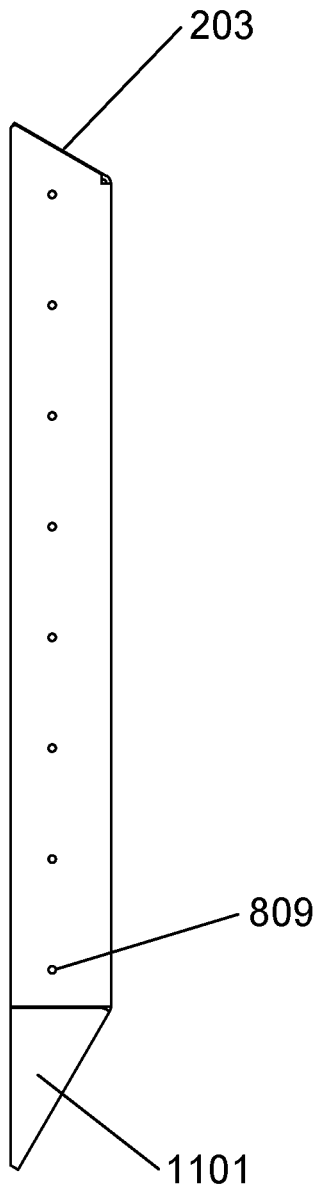
FIG. 12 is an alternate side view of the lower unit heat exchanger of FIG. 8.

Now turning to FIG. 11, a side view of the lower unit heat exchanger of FIG. 8 is depicted. A leading edge taper 1101 can be seen that contributes to proper marine environment fluid flow and also reduces the tendency for debris such as weeds to become fouled on the lower unit heat exchanger when the boat is in operation. In some embodiments, the leading edge taper is triangular. FIG. 12 is an alternate side view of the lower unit heat exchanger of FIG. 8. In both FIG. 11 and FIG. 12, fastener holes can be seen.

Figure 13:
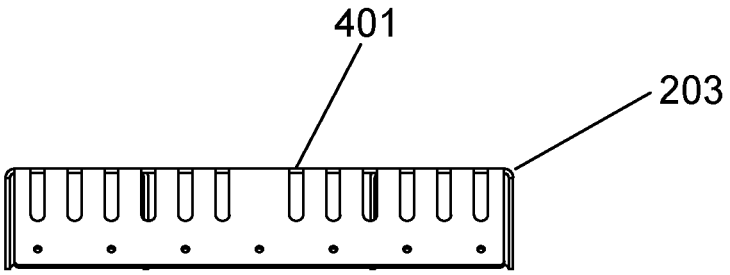
FIG. 13 is a rear side view of the lower unit heat exchanger of FIG. 8.

FIG. 13 is a rear side view of the lower unit heat exchanger of FIG. 8 showing clearly the configuration of the lower cooling slots 401.

Figure 14:
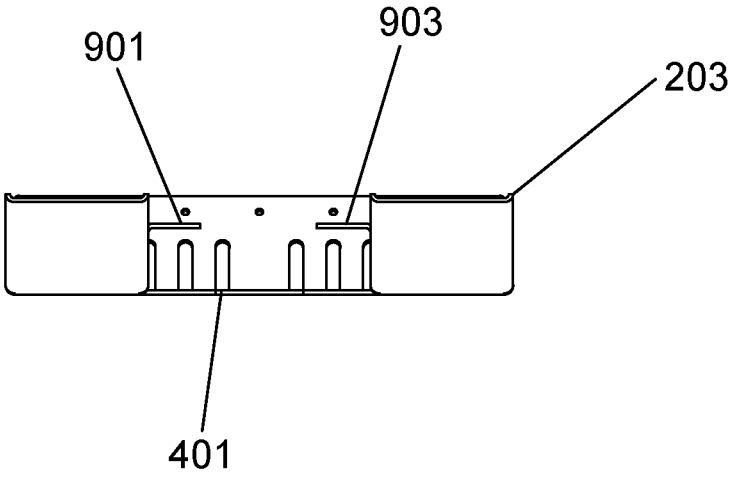
FIG. 14 is a front side view of the lower unit heat exchanger of FIG. 8.

FIG. 14 is a front side view of the lower unit heat exchanger of FIG. 8 where the planar geometry of the first mounting tab 901 and the second mounting tab 903 can be seen.

Figure 15:
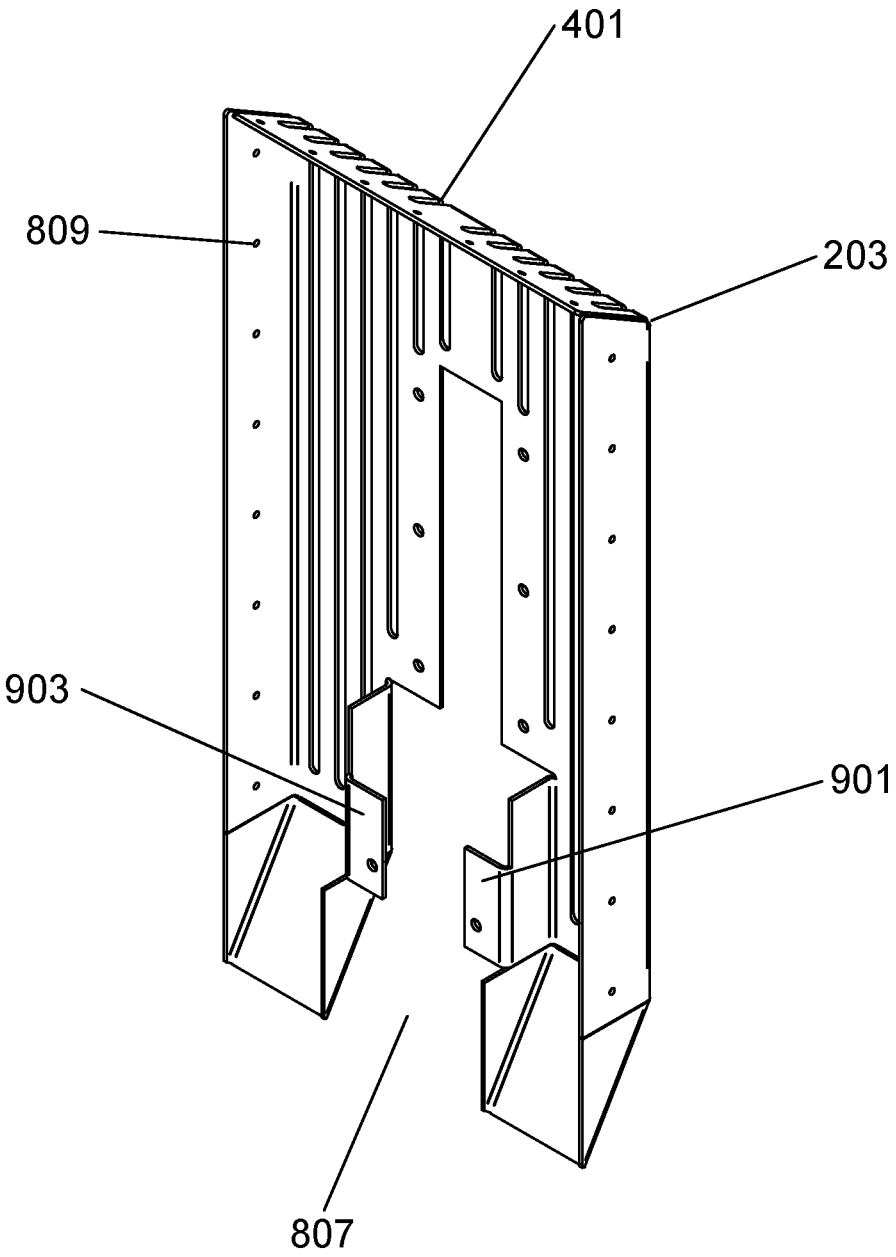
FIG. 15 is an inside perspective view of the housing lower half of the lower unit heat exchanger of FIG. 8.

FIG. 15 is an inside perspective view of the housing lower half of the lower unit heat exchanger of FIG. 8 where the mounting tabs and related mounting structure can be seen.

Figure 16:
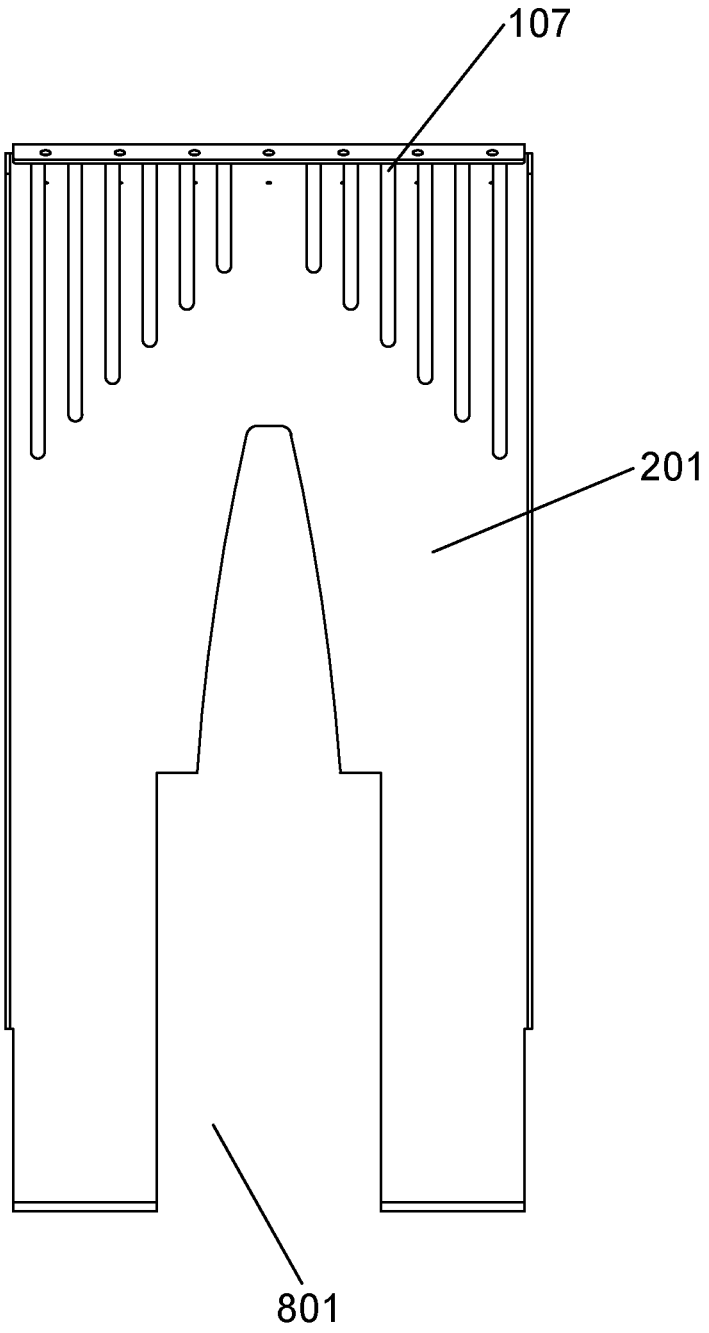
FIG. 16 is an inside plan view of the housing upper half of the lower unit heat exchanger of FIG. 8.

FIG. 16 is an inside plan view of the housing upper half of the lower unit heat exchanger of FIG. 8. The slightly different geometry of the lower unit opening 801 compared with the lower unit opening 807 of the housing lower half 203 can be seen. Varying geometries of the lower unit of the outboard motor as well as the attachment points contribute to this variation.

Figure 17:
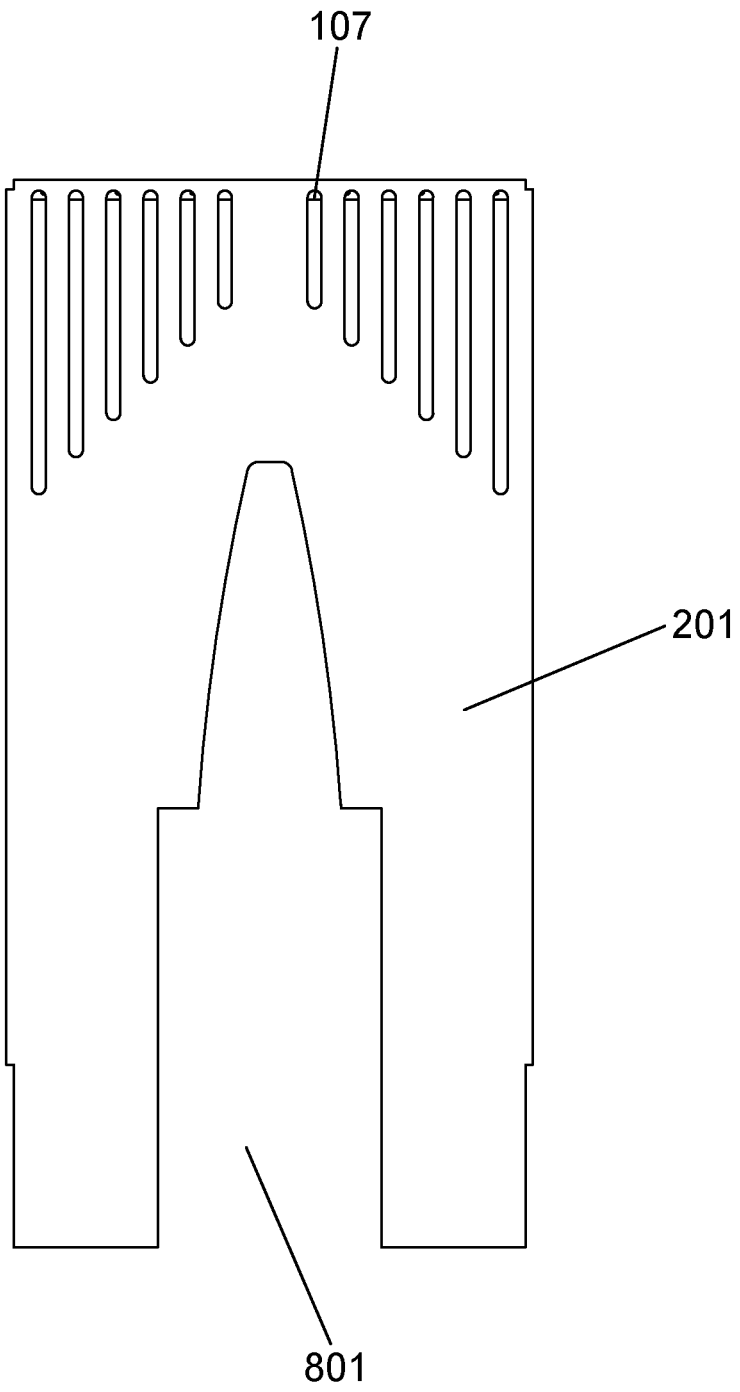
FIG. 17 is an outside plan view of the housing upper half of the lower unit heat exchanger of FIG. 8.

FIG. 17 is an outside plan view of the housing upper half 201 of the lower unit heat exchanger of FIG. 8. The upper cooling slots 107 can be seen.

Figure 18:
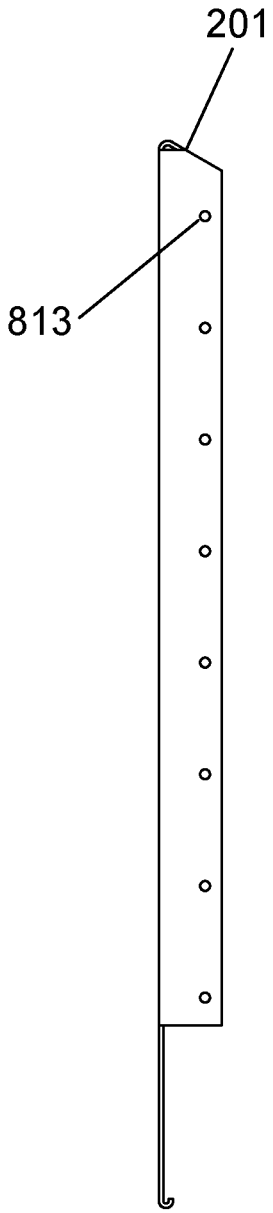
FIG. 18 is a side plan view of the housing upper half of the lower unit heat exchanger of FIG. 8.
Figure 19:
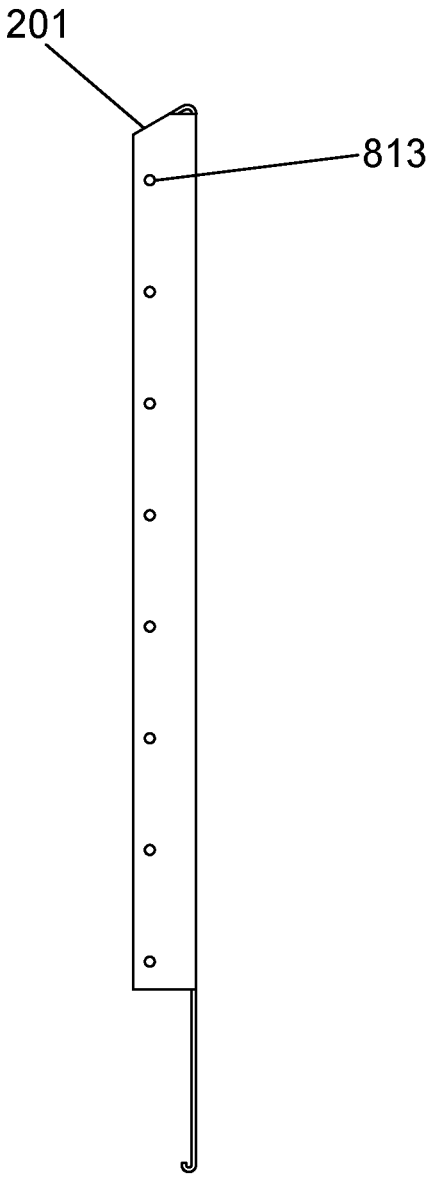
FIG. 19 is an alternate side plan view of the housing upper half of the lower unit heat exchanger of FIG. 8.

FIG. 18 is a side plan view of the housing upper half 201 of the lower unit heat exchanger of FIG. 8 and FIG. 19 is an alternate side plan view of the housing upper half 201 of the lower unit heat exchanger of FIG. 8.

Figure 20:
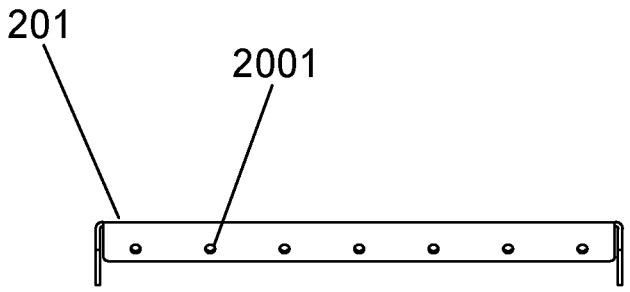
FIG. 20 is a rear side view of the housing upper half of the lower unit heat exchanger of FIG. 8.

FIG. 20 is a rear side view of the housing upper half 201 of the lower unit heat exchanger of FIG. 8 where cooling ports 2001 can be seen, providing a flow pathway for the marine environment water to exit during operation of the boat and associated outboard marine propulsion system.

Figure 21:
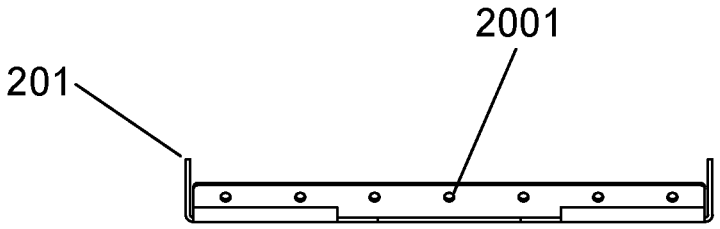
FIG. 21 is a front side view of the housing upper half of the lower unit heat exchanger of FIG. 8.

FIG. 21 is a front side view of the housing upper half 201 of the lower unit heat exchanger of FIG. 8.

Figure 22:
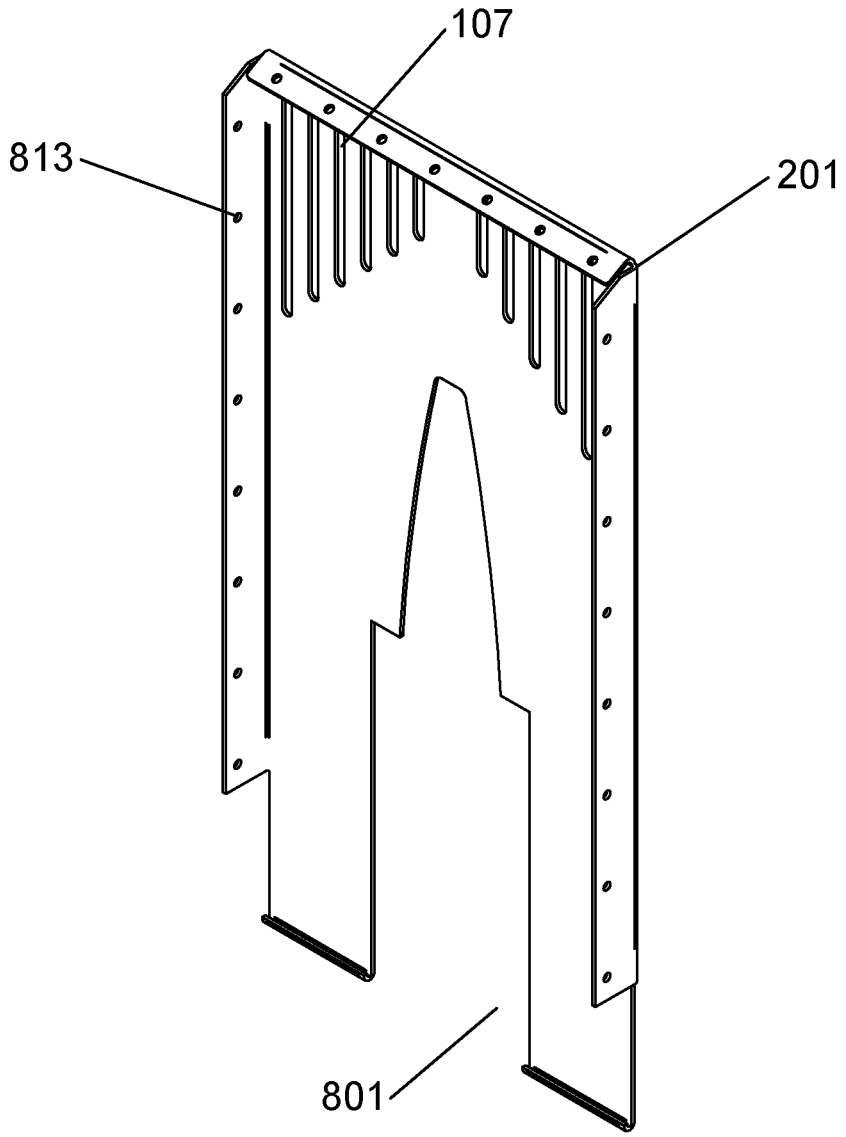
FIG. 22 is an inside perspective view of the housing upper half of the lower unit heat exchanger of FIG. 8.

FIG. 22 is an inside perspective view of the housing upper half 201 of the lower unit heat exchanger of FIG. 8. Angled edges can be seen with fastener holes 813 for joining to the housing lower half 203.

Figure 23:
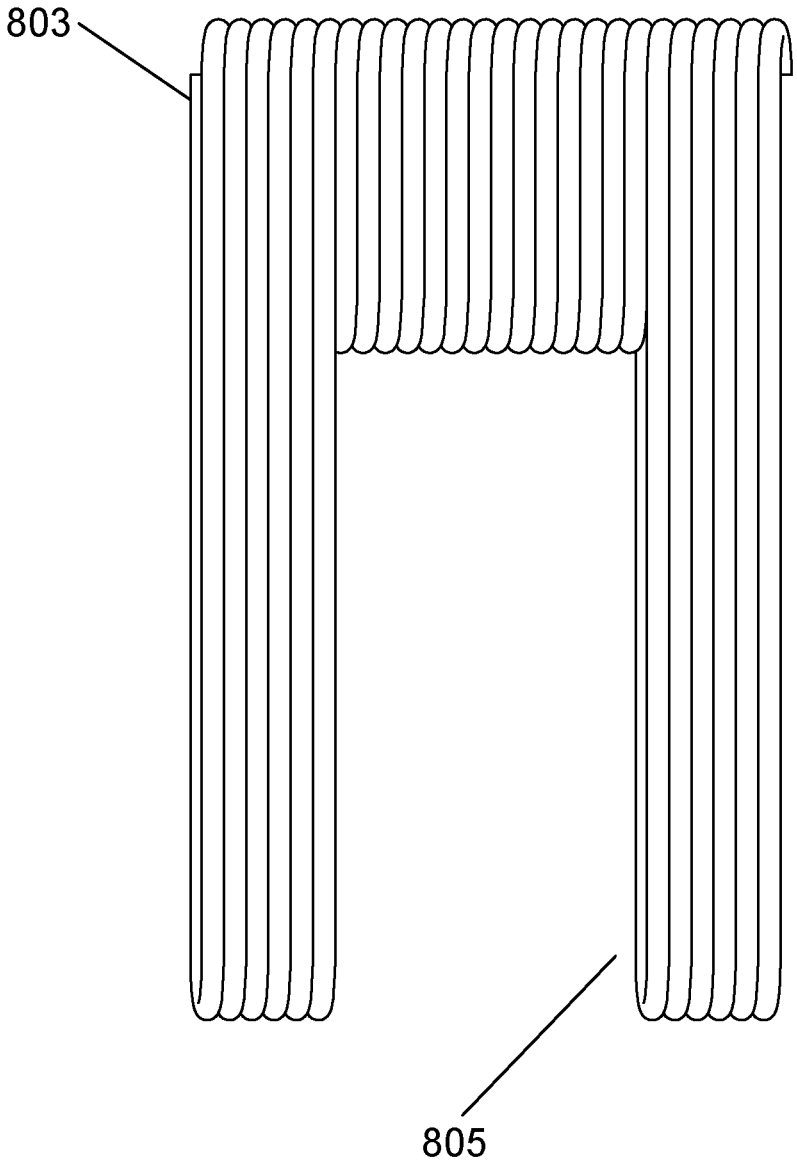
FIG. 23 is a perspective view of the cooling coil of the lower unit heat exchanger of FIG. 8.

FIG. 23 is a perspective view of the cooling coil 803 of the lower unit heat exchanger of FIG. 8. The cooling coil 803 is made from tubing or other conduit or passageway for the flow of coolant or cooling fluid, and is bent or otherwise formed into the coil geometry depicted. The tubing may be, for example, aluminum tubing to provide for good heat transfer from the coolant to the surrounding marine environment. To accommodate the lower unit, the cooling coil is configured with a middle section that is shorter than each side section. The cooling coil 803 forms a U shape of sorts. Each side of the cooling coil 803 is in fluid communication with the cooling system of the outboard marine propulsion system.

Figure 24:
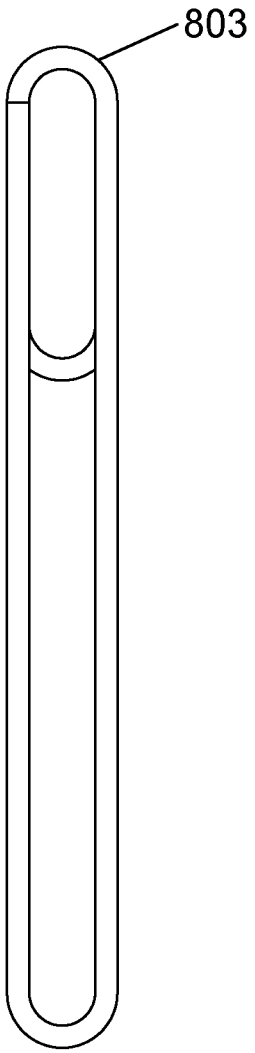
FIG. 24 is a side view of the cooling coil of the lower unit heat exchanger of FIG. 8.
Figure 25:
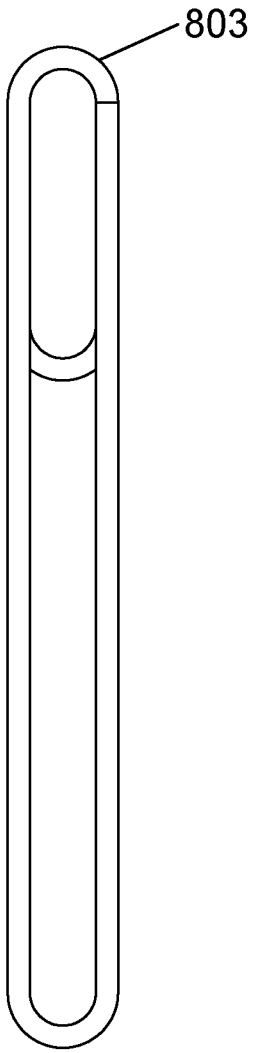
FIG. 25 is an alternate side view of the cooling coil of the lower unit heat exchanger of FIG. 8.
Figure 26:
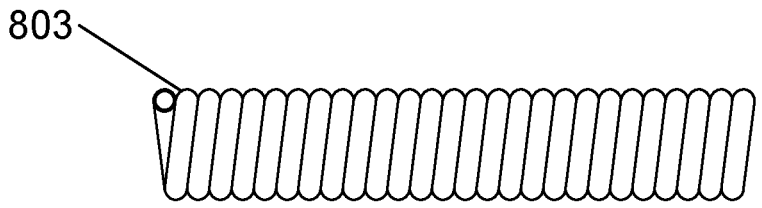
FIG. 26 is a front side view of the cooling coil of the lower unit heat exchanger of FIG. 8.
Figure 27:
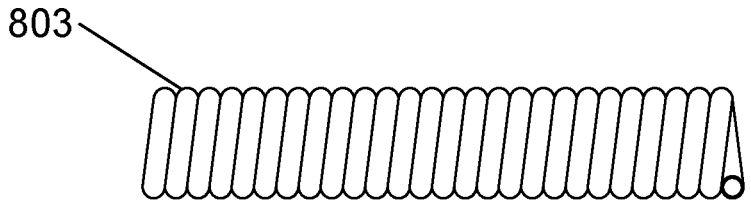
FIG. 27 is a rear side view of the cooling coil of the lower unit heat exchanger of FIG. 8.

FIG. 24 is a side view of the cooling coil 803 of the lower unit heat exchanger of FIG. 8 and FIG. 25 is an alternate side view of the cooling coil 803 of the lower unit heat exchanger of FIG. 8. FIG. 26 is a front side view of the cooling coil 803 of the lower unit heat exchanger of FIG. 8 and FIG. 27 is a rear side view of the cooling coil 803 of the lower unit heat exchanger of FIG. 8.

Figure 28:
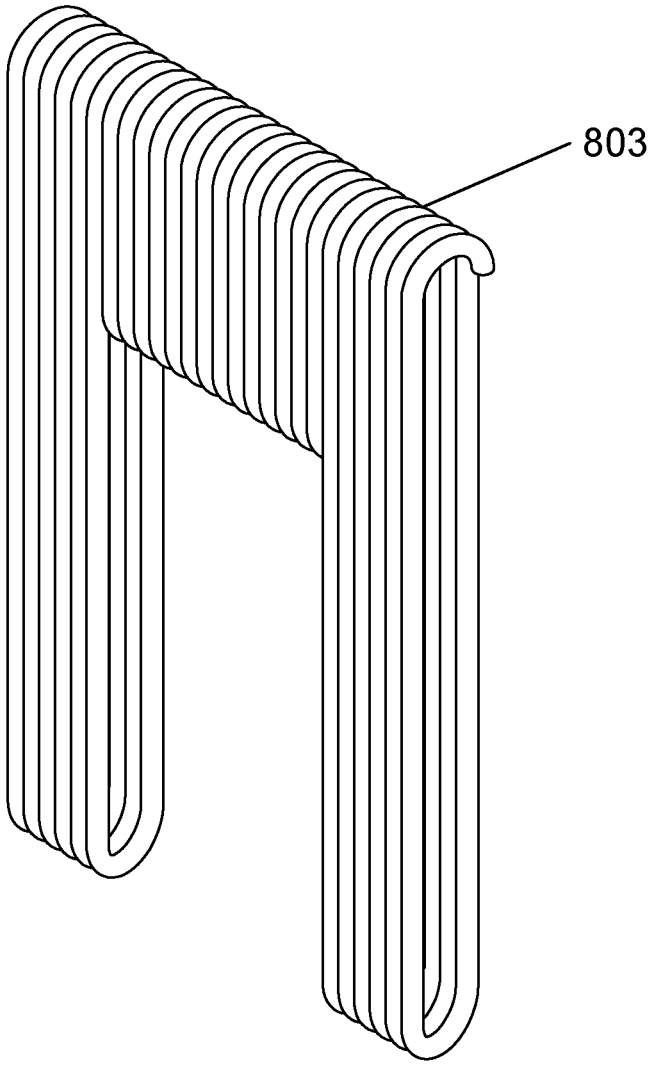
FIG. 28 is a perspective view of the cooling coil of the lower unit heat exchanger of FIG. 8.

FIG. 28 depicts a perspective view of the cooling coil 803 of the lower unit heat exchanger of FIG. 8. A coupling or other fluidic connection is employed on each end of the cooling coil 803 to join with hose or tubing that is connected with the cooling system of the outboard marine propulsion system.

Figure 29:
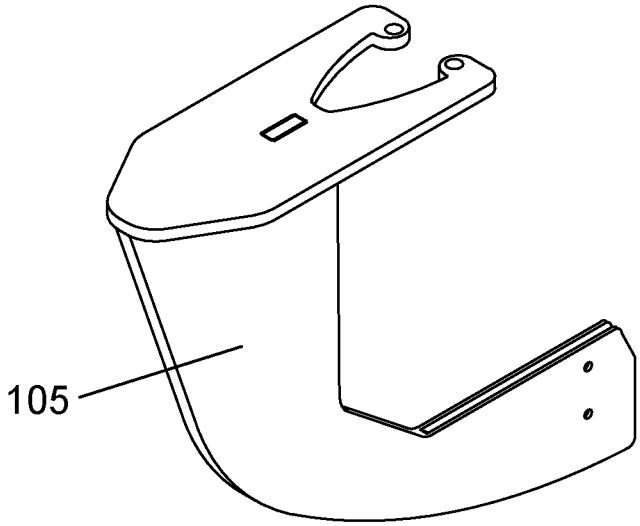
FIG. 29 is a perspective view of the front guard assembly of the outboard marine propulsion system of FIG. 1.

FIG. 29 is a perspective view of the front guard assembly 105 of the outboard marine propulsion system of FIG. 1. The front guard assembly 105 attaches to the lower unit of the outboard marine propulsion system to protect the lower unit heat exchanger and the lower unit overall. The front guard assembly 105 has a curved or boomerang like shape and a horizontally disposed upper portion for attachment to the lower unit of the outboard marine propulsion system. The front guard assembly 105 is fabricated from a material with strength to withstand impact of debris such as branches, logs, and the like. Suitable materials include steel, brass, aluminum, and the like.

Figure 30:
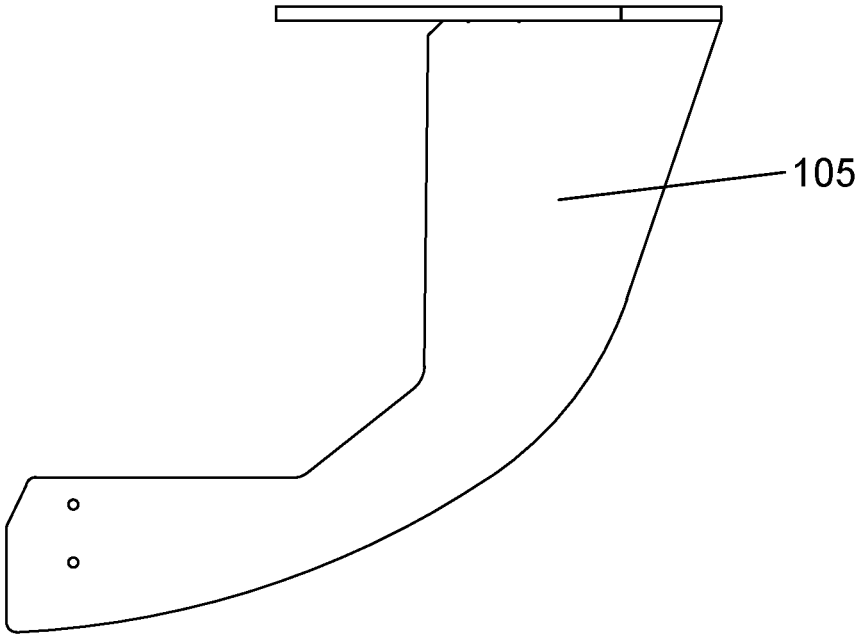
FIG. 30 is a side view of the front guard assembly of the outboard marine propulsion system of FIG. 1.
Figure 31:
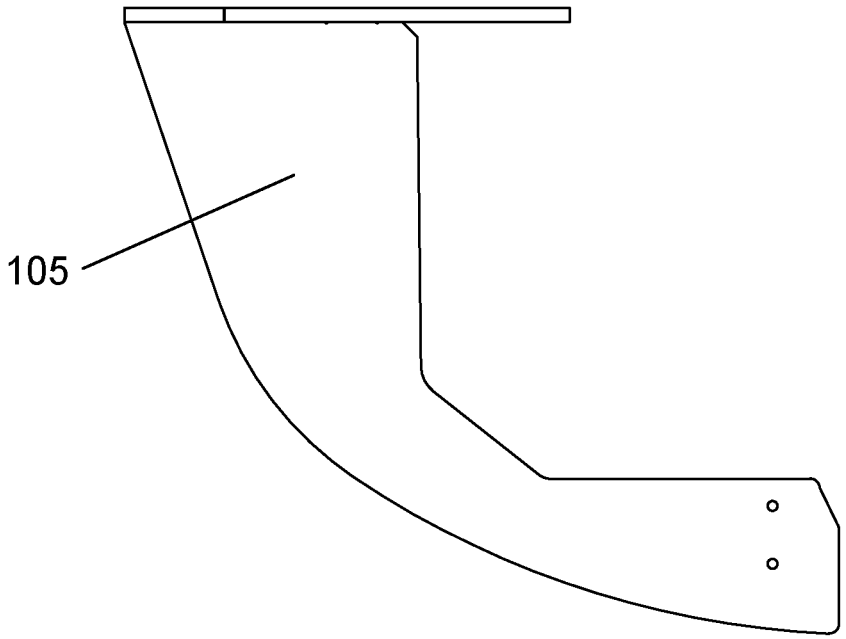
FIG. 31 is an alternate side view of the front guard assembly of the outboard marine propulsion system of FIG. 1.
Figure 32:
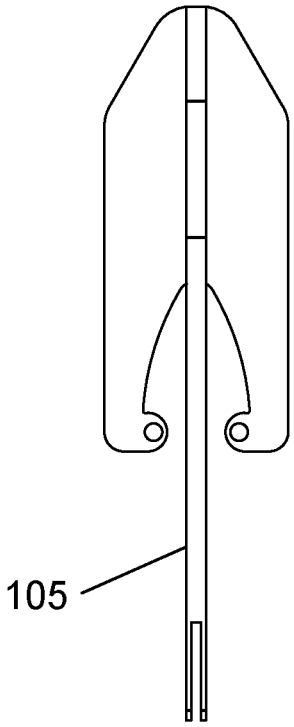
FIG. 32 is a bottom plan view of the front guard assembly of the outboard marine propulsion system of FIG. 1.
Figure 33:
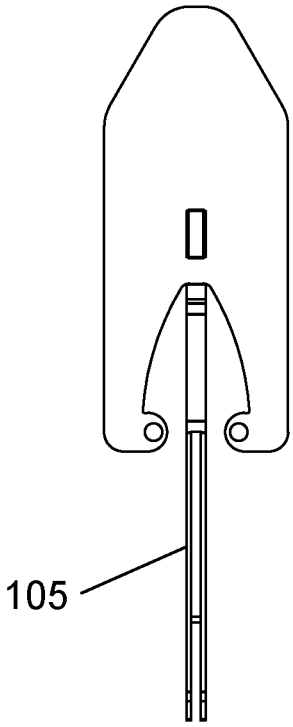
FIG. 33 is a top plan view of the front guard assembly of the outboard marine propulsion system of FIG. 1.
Figure 34:
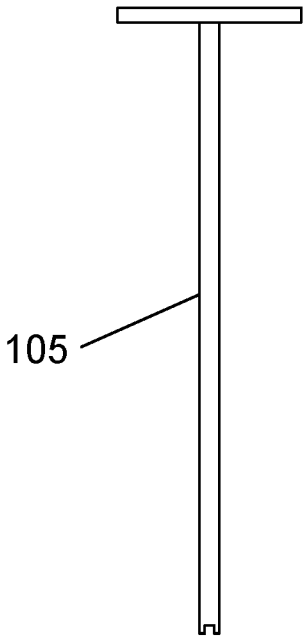
FIG. 34 is a front plan view of the front guard assembly of the outboard marine propulsion system of FIG. 1.
Figure 35:
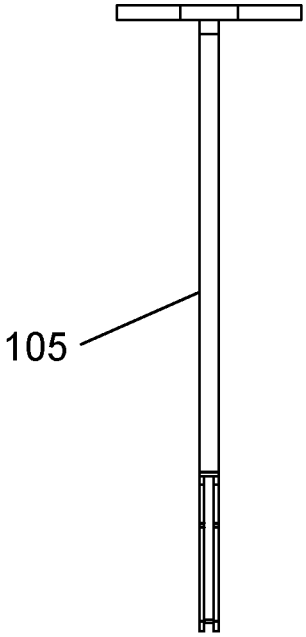
FIG. 35 is a rear plan view of the front guard assembly of the outboard marine propulsion system of FIG. 1.

FIG. 30 is a side view of the front guard assembly 105 of the outboard marine propulsion system of FIG. 1. FIG. 31 is an alternate side view of the front guard assembly 105 of the outboard marine propulsion system of FIG. 1. FIG. 32 is a bottom plan view of the front guard assembly 105 of the outboard marine propulsion system of FIG. 1. FIG. 33 is a top plan view of the front guard assembly 105 of the outboard marine propulsion system of FIG. 1. FIG. 34 is a front plan view of the front guard assembly 105 of the outboard marine propulsion system of FIG. 1 and FIG. 35 is a rear plan view of the front guard assembly 105 of the outboard marine propulsion system of FIG. 1. The front guard assembly 105 provides protection of lower unit heat exchanger and the marine propulsion unit from underwater obstacles that could otherwise inflict damage on the marine propulsion unit while in motion. The front guard assembly 105 may be shaped to conform to the leading edge of the outboard motor, and may, in some embodiments of the present invention, be shaped similar to a boomerang, hockey stick blade, or the like. The angled or otherwise shaped front guard assembly 105 is retained by an upper attachment plate and a lower attachment.

Turning now to FIGS. 36-58, a second embodiment of a lower unit heat exchanger of the present invention is illustrated. The lower unit heat exchanger comprises a lower unit trailing heat exchanger and a lower unit leading heat exchanger in fluid communication with each other and with the cooling system of an outboard marine propulsion system.

The heat exchanger components, namely the lower unit trailing heat exchanger 3601 which comprises the first cooling foil 3701 and the second cooling foil 3703, as well as the lower unit leading heat exchanger 3603, are made from a metal such as aluminum, brass, stainless steel, or the like. Manufacturing techniques include, but are not limited to, casting, machining, 3D printing, and the like. Due to the interior cooling passageways, 3D printing may be a viable and cost effective manufacturing approach, although other manufacturing techniques such as, but not limited to, lost wax casting may also be practical.

Figure 36:
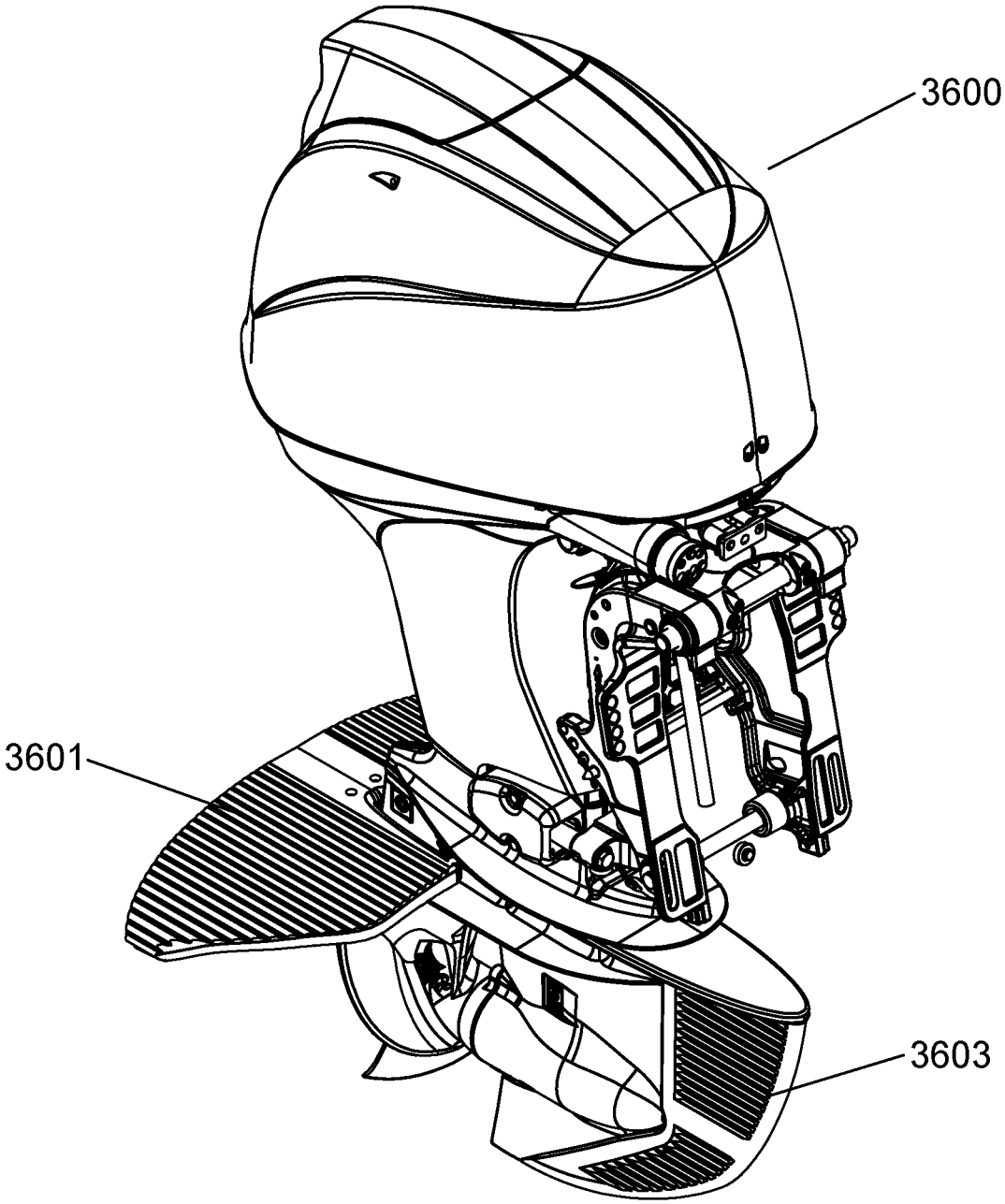
FIG. 36 is a perspective view of an outboard marine propulsion system fitted with a second embodiment of a lower unit heat exchanger of the present invention.

FIG. 36 is a perspective view of an outboard marine propulsion system 3600 fitted with the second embodiment of a lower unit heat exchanger of the present invention. The lower unit trailing heat exchanger 3601 and the lower unit leading heat exchanger can be clearly seen along with their geometries and the attachment to the outboard marine propulsion system 3600. The lower unit trailing heat exchanger 3601 attaches to the anti-cavitation plate of the outboard marine propulsion system 3600 with bolts, screws or similar hardware. Each of the lower unit heat exchangers contains serpentine passageways for the flow of coolant. The serpentine passageways may be round, rectangular, oval, or any convenient geometry, and travel throughout the interior of each heat exchanger in a winding, coiled or serpentine path. Each of the two heat exchangers—the lower unit trailing heat exchanger 3601 and the lower unit leading heat exchanger 3603 are in fluid communication with each other and with the cooling system of the outboard marine propulsion system. In one embodiment, tubing is used to connect the lower unit trailing heat exchanger 3601 and the lower unit leading heat exchanger 3603. The tubing may be aluminum tubing, rubber tubing, or the like. The lower unit leading heat exchanger 3603 has a horizontally disposed attachment plate that attaches to the lower unit of the outboard marine propulsion system 3600 with bolts, screws, or similar hardware.

Figure 37:
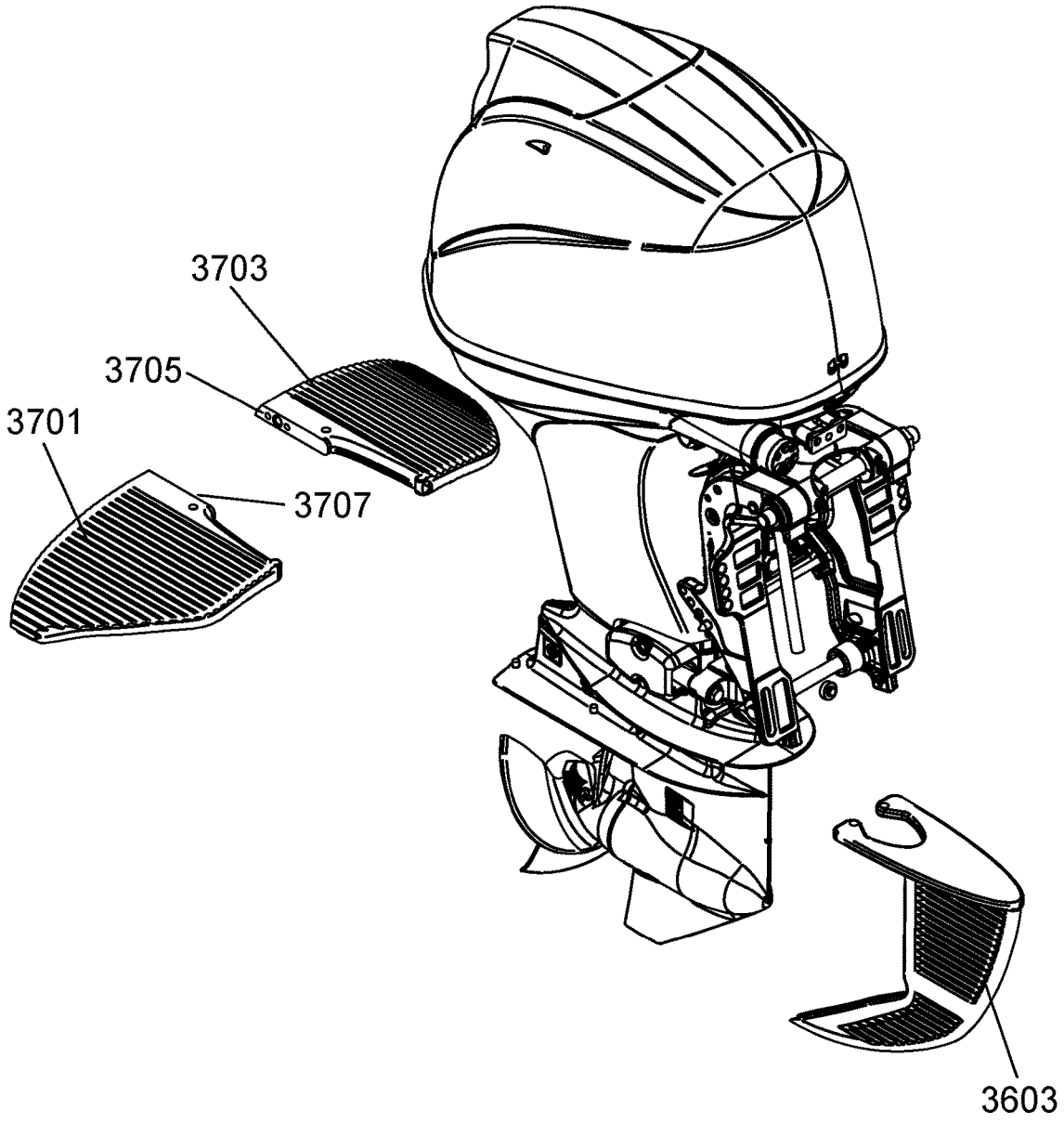
FIG. 37 is an exploded view of the outboard marine propulsion system of FIG. 36.

FIG. 37 is an exploded view of the outboard marine propulsion system of FIG. 36. The lower unit leading heat exchanger 3603 also serves as a front guard to protect the heat exchangers as well as the outboard motor from errant impact with debris or obstructions. The lower unit trailing heat exchanger comprises a first cooling foil 3701 and a second cooling foil 3703 that are joined together and in fluid communication with each other by way of first cooling foil coolant port 3707 and a second cooling foil coolant port 3705. The coolant ports are mated together and mechanically joined. A seal such as an o-ring or gasket may further be employed to ensure a liquid tight seal.

Figure 38:
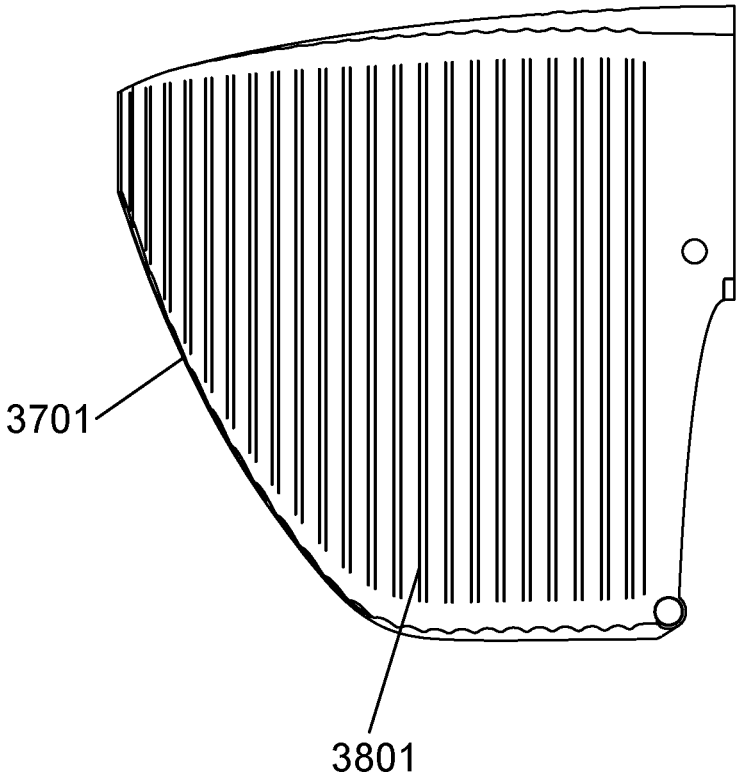
FIG. 38 is a top plan view of a first cooling foil of the outboard marine propulsion system of FIG. 36.

FIG. 38 is a top plan view of a first cooling foil 3701 of the outboard marine propulsion system of FIG. 36. Cooling ridges 3801 can be seen, which serve to increase the surface area and result in increased heat transfer. Each cooling foil has a tapered form with a gradual downward slope.

Figure 39:
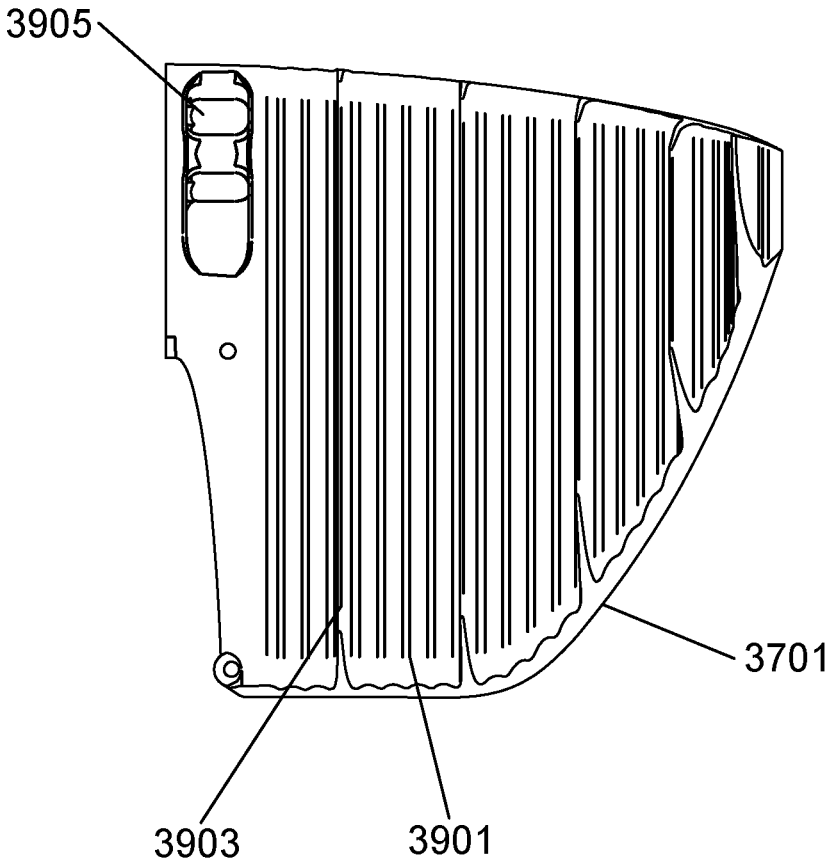
FIG. 39 is a bottom plan view of the first cooling foil of FIG. 38.

FIG. 39 is a bottom plan view of the first cooling foil. Cooling ridges 3901 can be seen as well as primary ridges 3903 that alternate between the cooling ridges 3901 and provide further surface area as well as structural reinforcement to the cooling foil and improved performance. Also seen is a fastening recess 3905 that allows for placement of joining hardware that connects each of the cooling foils and associated coolant ports together. Joining hardware such as a bolt is placed in the fastening recess and through a hole in the coolant port face of the cooling foil.

Figure 40:
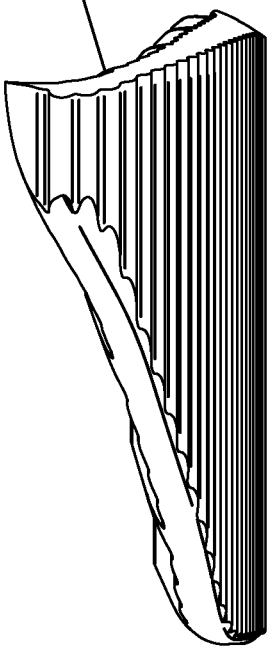
FIG. 40 is an outer side plan view of the first cooling foil of FIG. 38.

FIG. 40 is an outer side plan view of the first cooling foil 3701 clearly showing the curvature of the cooling foil and the taper thereof.

Figure 41:
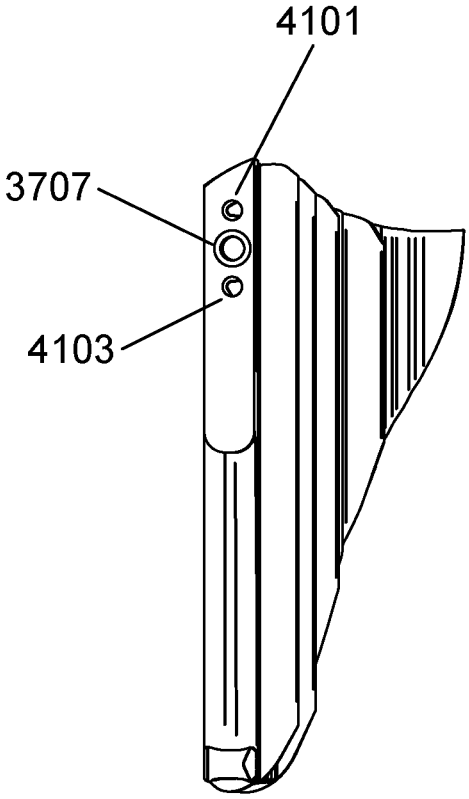
FIG. 41 is an inner side plan view of the first cooling foil of FIG. 38.

FIG. 41 is an inner side plan view of the first cooling foil showing a first fastener insert 4101 and a second fastener insert 4103 on each side of the coolant port 3707.

Figure 42:
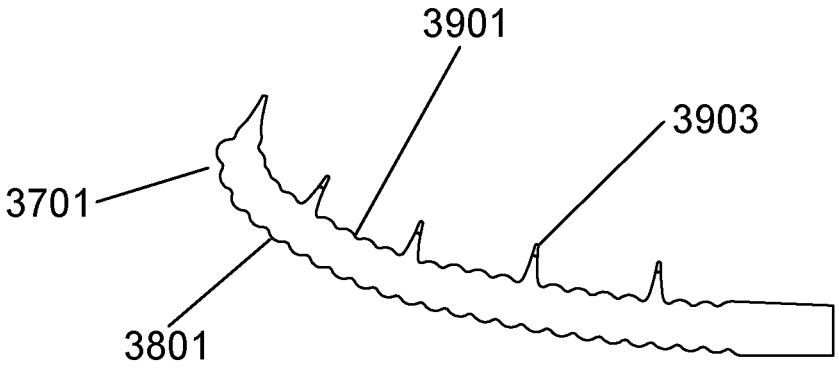
FIG. 42 is a front side plan view of the first cooling foil of FIG. 38.
Figure 43:
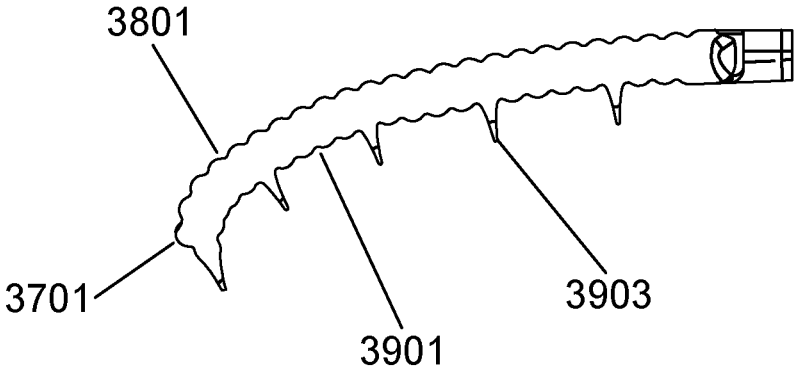
FIG. 43 is a rear side plan view of the first cooling foil of FIG. 38.

FIG. 42 is a front side plan view of the first cooling foil and FIG. 43 is a rear side plan view of the first cooling foil. The cooling ridges 3901 and primary ridges 3903 can be seen along with the curvature of the first cooling foil.

Figure 44:
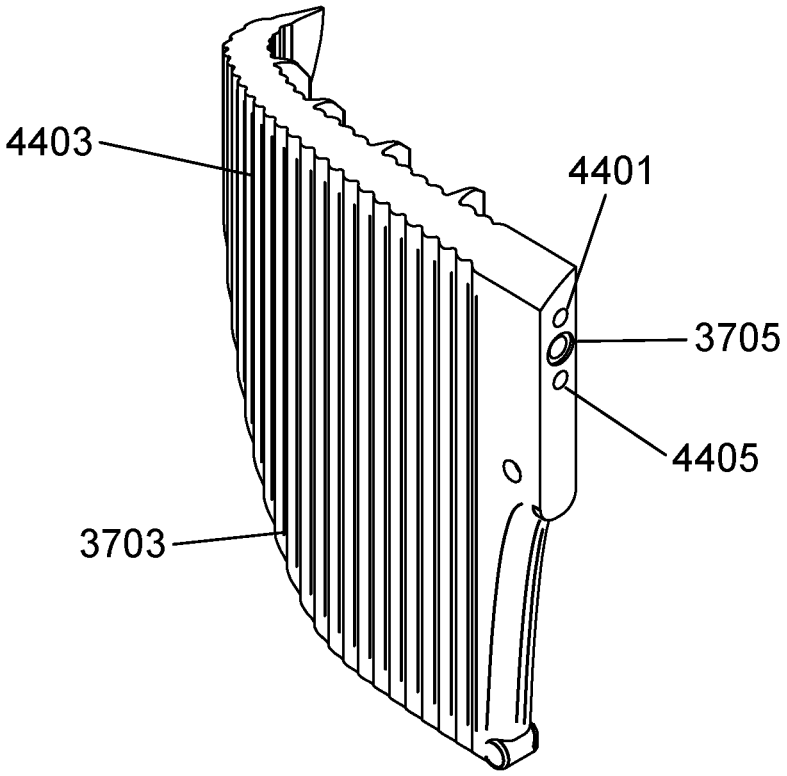
FIG. 44 is a perspective view of a second cooling foil of the outboard marine propulsion system of FIG. 36.

FIG. 44 is a perspective view of a second cooling foil 3703 of the outboard marine propulsion system of FIG. 36. A first fastener insert 4401 and a second fastener insert 4405 can be seen on either side of the coolant port 3705. Cooling ridges 4403 can also be seen.

Figure 45:
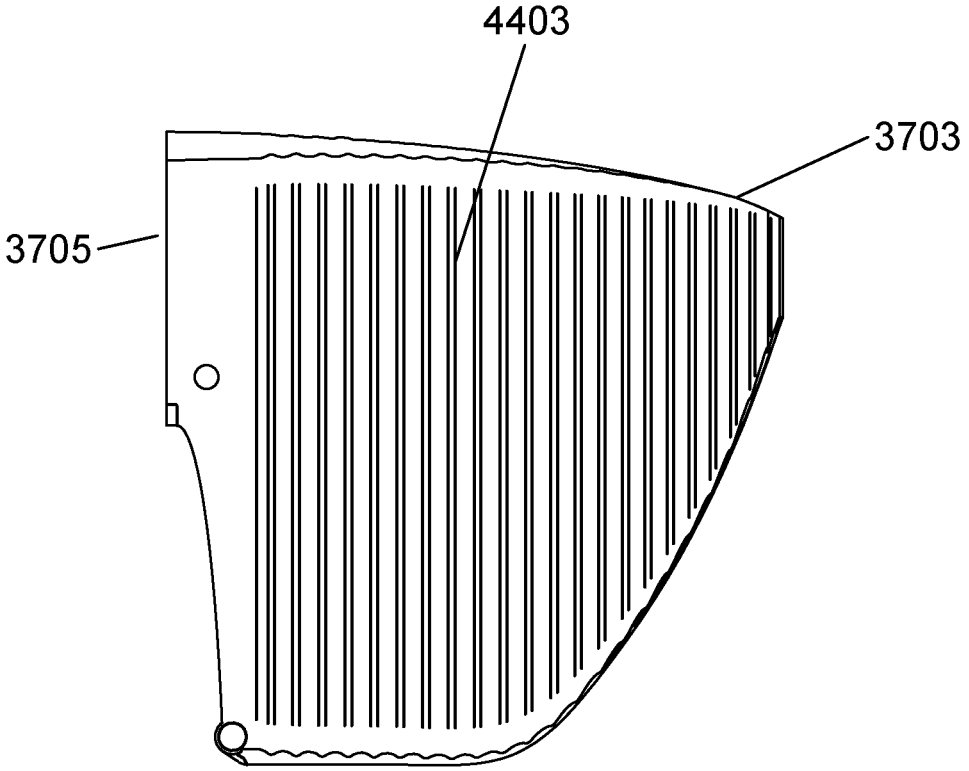
FIG. 45 is a top plan view of the second cooling foil of FIG. 44.

FIG. 45 is a top plan view of the second cooling foil 3703. The cooling ridges 4403 can be clearly seen along with the gradual curved taper and associated geometries.

Figure 46:
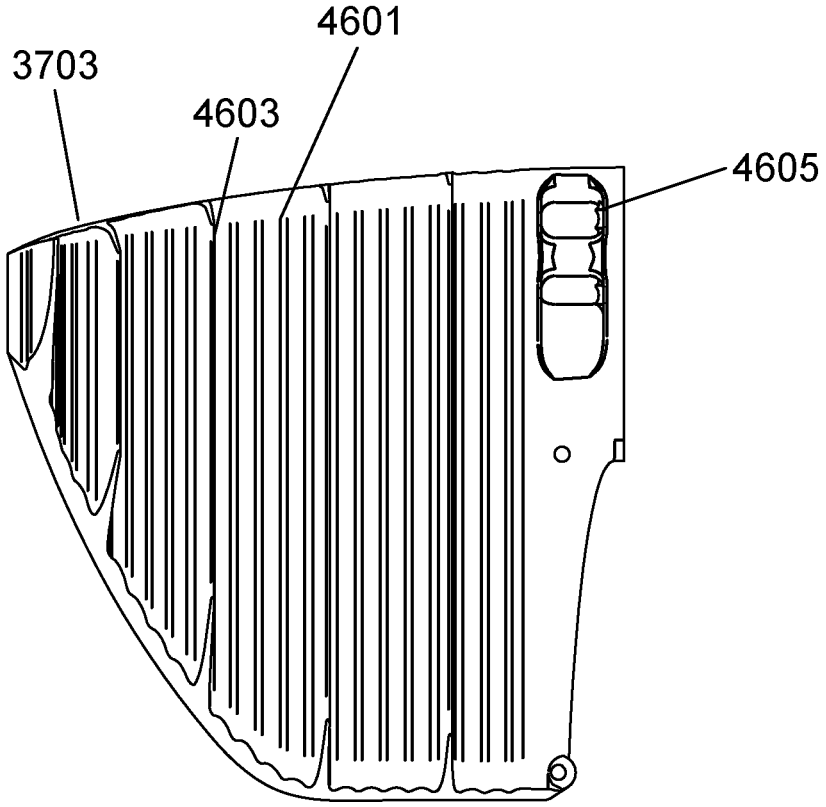
FIG. 46 is a bottom plan view of the second cooling foil of FIG. 44.

FIG. 46 is a bottom plan view of the second cooling foil 3703. Both primary ridges 4603 as well as cooling ridges 4601 can be seen. The primary ridges 4603 alternate between the cooling ridges 4601 and provide further surface area as well as structural reinforcement to the cooling foil and improved performance. Also seen is a fastening recess 4605 that allows for placement of joining hardware that connects each of the cooling foils and associated coolant ports together. Joining hardware such as a bolt is placed in the fastening recess and through a hole in the coolant port face of the cooling foil.

Figure 47:
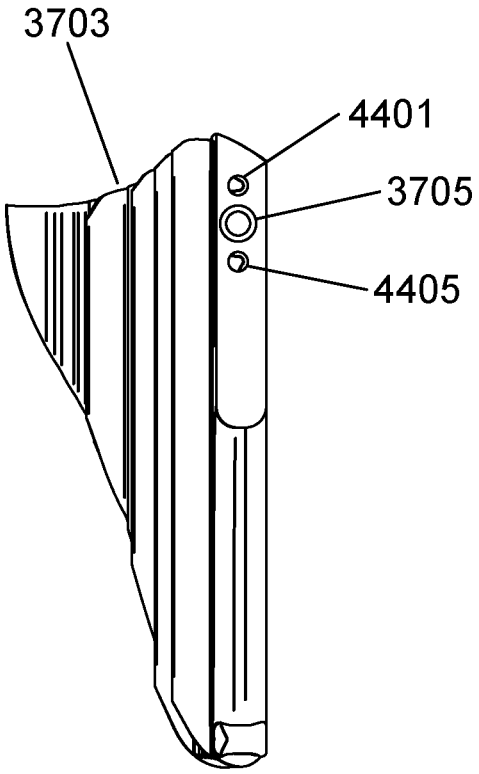
FIG. 47 is an inner side plan view of the second cooling foil of FIG. 44.

FIG. 47 is an inner side plan view of the second cooling foil 3703 where the first fastener insert 4401 and the second fastener insert 4405 can be seen adjacent to the coolant port 3705. The fastener inserts may simply be machined holes to the fastening recess, or they may have threads, fastener inserts, or the like.

Figure 48:
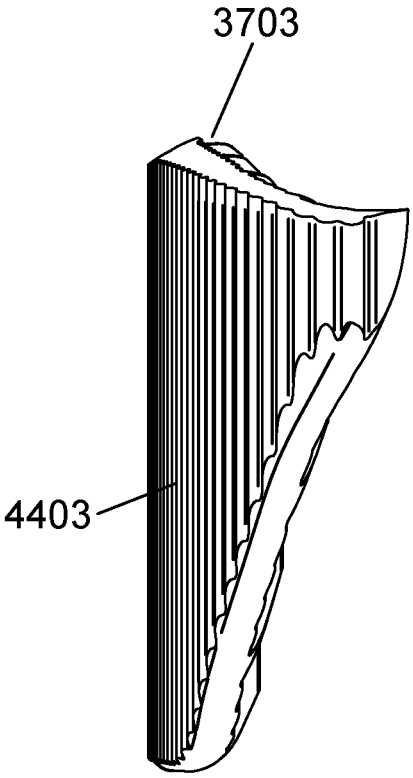
FIG. 48 is an outer side plan view of the second cooling foil of FIG. 44.

FIG. 48 is an outer side plan view of the second cooling foil 3703. The second cooling foil and the first cooling foil are complimentary and symmetrical, and when joined together maximizes marine water flow and heat transfer during operation of the outboard motor, and also provides improved operating performance in the areas of boat stability, low speed operation and planing, and the like.

Figure 49:
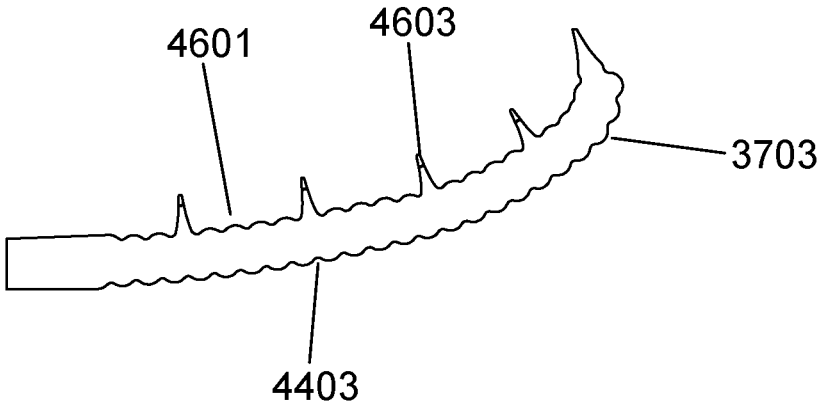
FIG. 49 is a front side plan view of the second cooling foil of FIG. 44.
Figure 50:
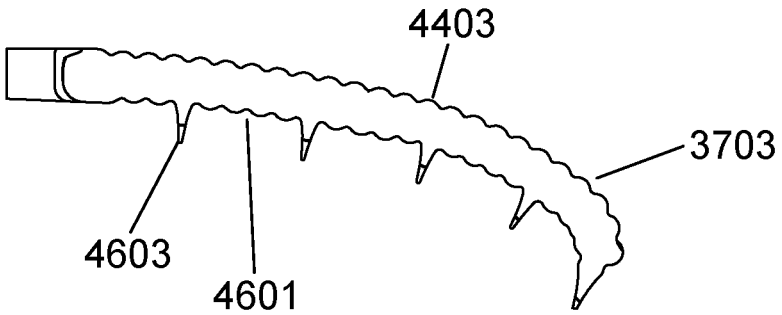
FIG. 50 is a rear side plan view of the second cooling foil of FIG. 44.

FIG. 49 is a front side plan view of the second cooling foil 3703 and FIG. 50 is a rear side plan view of the second cooling foil of FIG. 44. The cooling ridges 4403 as well as the primary ridges 3903 can be seen along with the curvature of the cooling foil.

Figure 51:
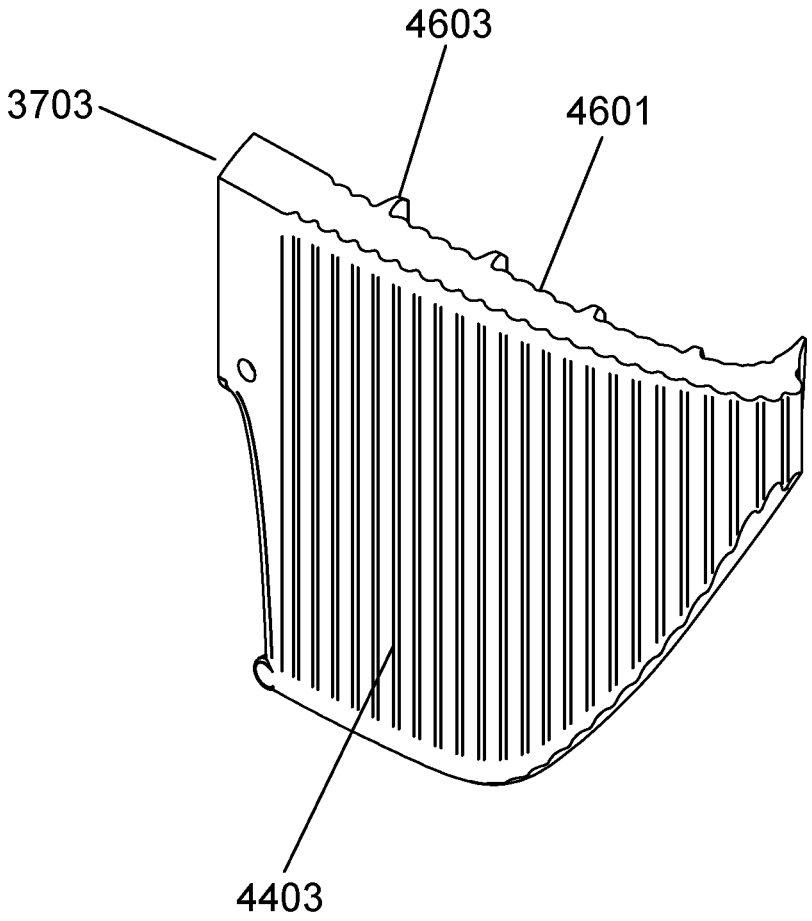
FIG. 51 is a top perspective view of the second cooling foil of FIG. 44.

FIG. 51 is a top perspective view of the second cooling foil 3703 showing the curvature and tapered geometry of the cooling foil as well as the recess along the inward facing edge to accommodate the lower unit of an outboard marine propulsion system.

Figure 52:
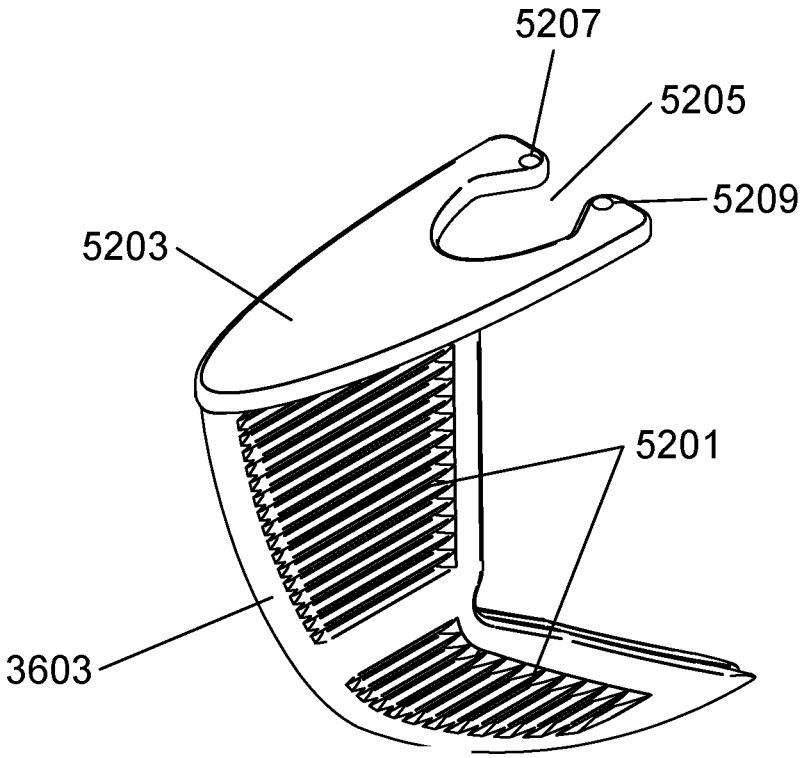
FIG. 52 is a perspective view of a lower unit leading heat exchanger of the outboard marine propulsion system of FIG. 36.

FIG. 52 is a perspective view of a lower unit leading heat exchanger 3603 of the outboard marine propulsion system of FIG. 36. Cooling ridges 5201 can be seen along the exterior surface. Serpentine coolant passageways can be found within the lower unit leading heat exchanger 3603, as previously described. The lower unit heading heat exchanger 3603 is shaped similar to a boomerang, hockey stick blade, or the like, and serves to provide protection to the lower unit and associated heat exchangers during operation. An upper support 5203 can be seen horizontally disposed and with a lower unit opening 5205 and fastener holes 5207 and 5209 for securing the upper support 5203 to the lower unit of the outboard marine propulsion system.

Figure 53:
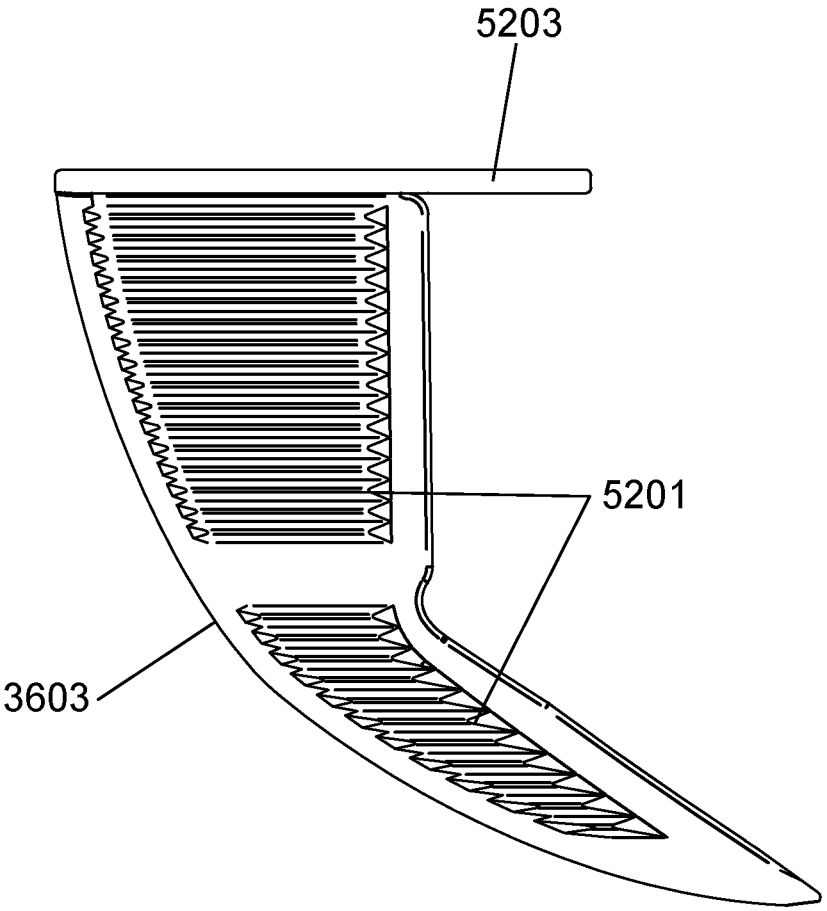
FIG. 53 is a side view of the lower unit leading heat exchanger of FIG. 52.
Figure 54:
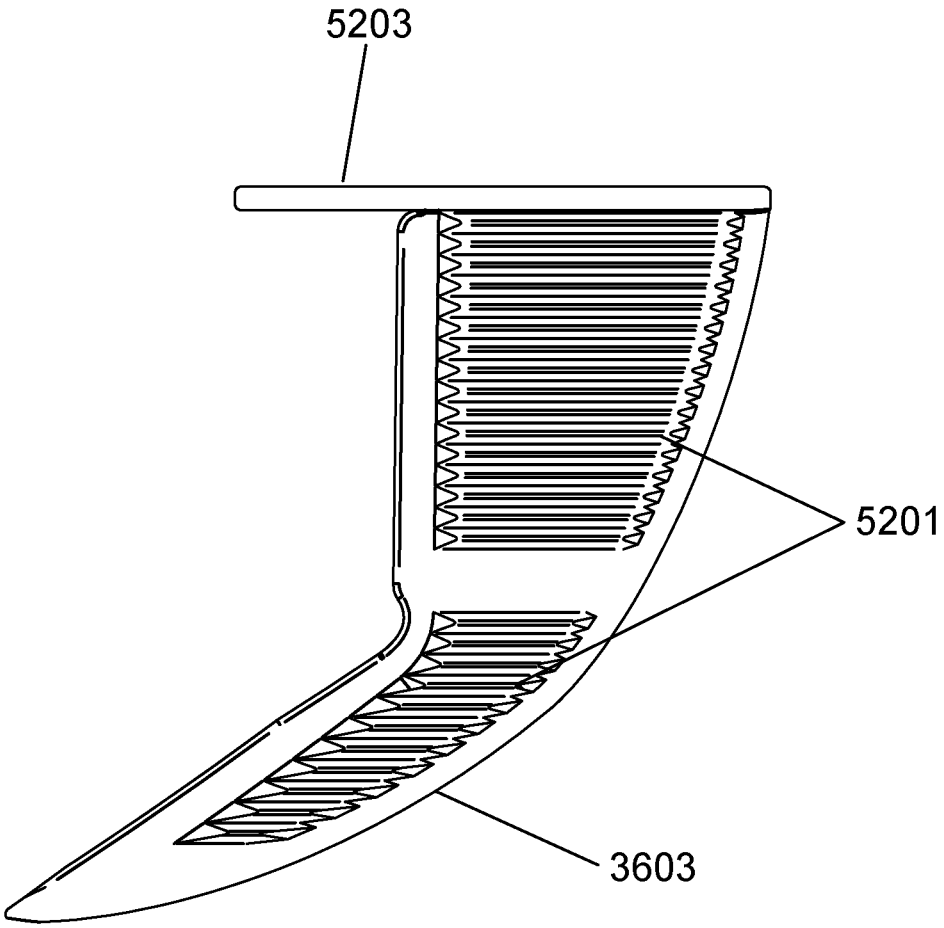
FIG. 54 is an alternate side view of the lower unit leading heat exchanger of FIG. 52.

FIG. 53 is a side view of the lower unit leading heat exchanger 3603 showing the cooling ridges 5201 and the general shape of the heat exchanger. FIG. 54 is an alternate side view of the lower unit leading heat exchanger 3603.

Figure 55:
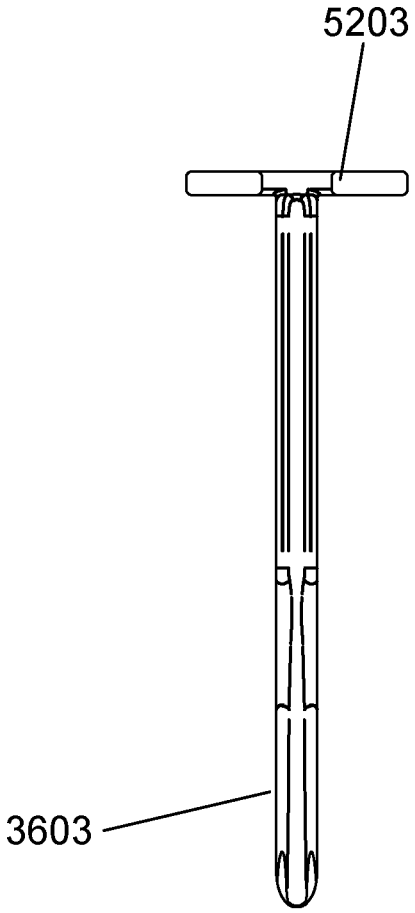
FIG. 55 is a rear side view of the lower unit leading heat exchanger of FIG. 52.
Figure 56:
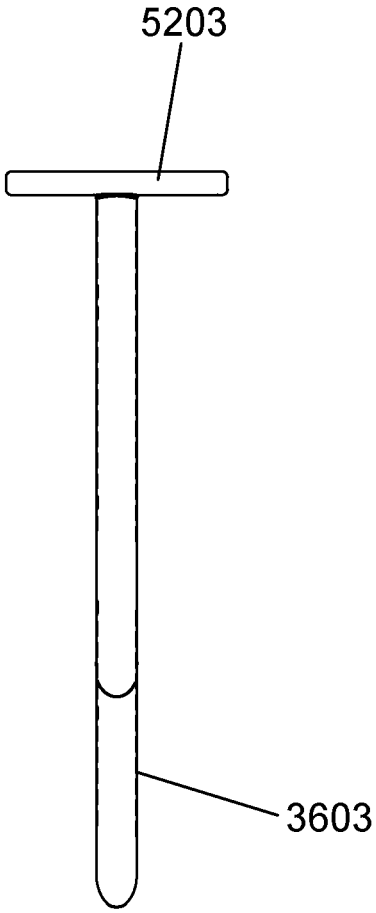
FIG. 56 is a front side view of the lower unit leading heat exchanger of FIG. 52.

FIG. 55 is a rear side view of the lower unit leading heat exchanger 3603 and FIG. 56 is a front side view of the lower unit leading heat exchanger 3603. It should be noted that the heat exchanger may contain additional material to add strength to the structure in the event of impact with underwater debris such as branches, logs, and the like.

Figure 57:
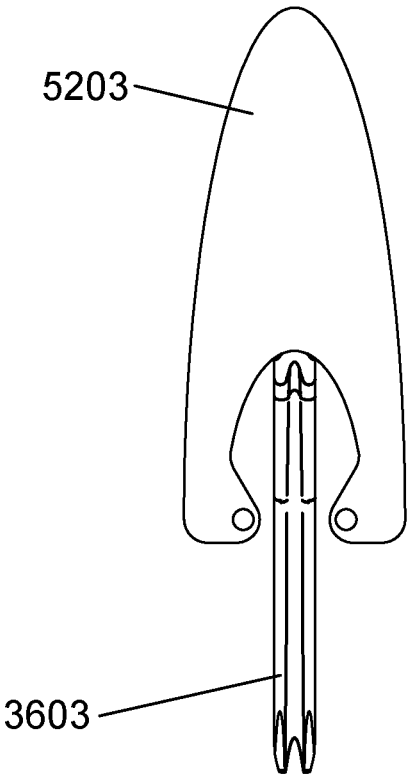
FIG. 57 is a top plan view of the lower unit leading heat exchanger of FIG. 52.
Figure 58:
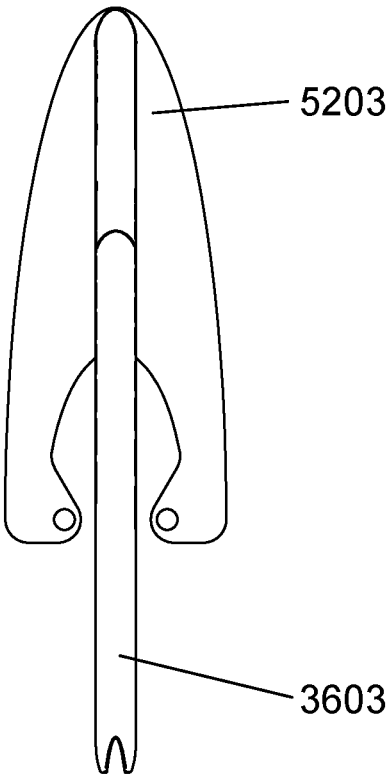
FIG. 58 is a bottom plan view of the lower unit leading heat exchanger of FIG. 52.

FIG. 57 is a top plan view of the lower unit leading heat exchanger 3603 that clearly shows the upper support 5203 and the mounting holes. FIG. 58 is a bottom plan view of the lower unit leading heat exchanger 3603 showing the relationship between the vertical fin and the upper support.

While the outboard marine propulsion system has been described by way of an outboard motor that is propeller driven, other forms of marine propulsion systems exist and many, if not all, can benefit from various embodiments of the present invention as described and envisioned herein.

Figure 59:
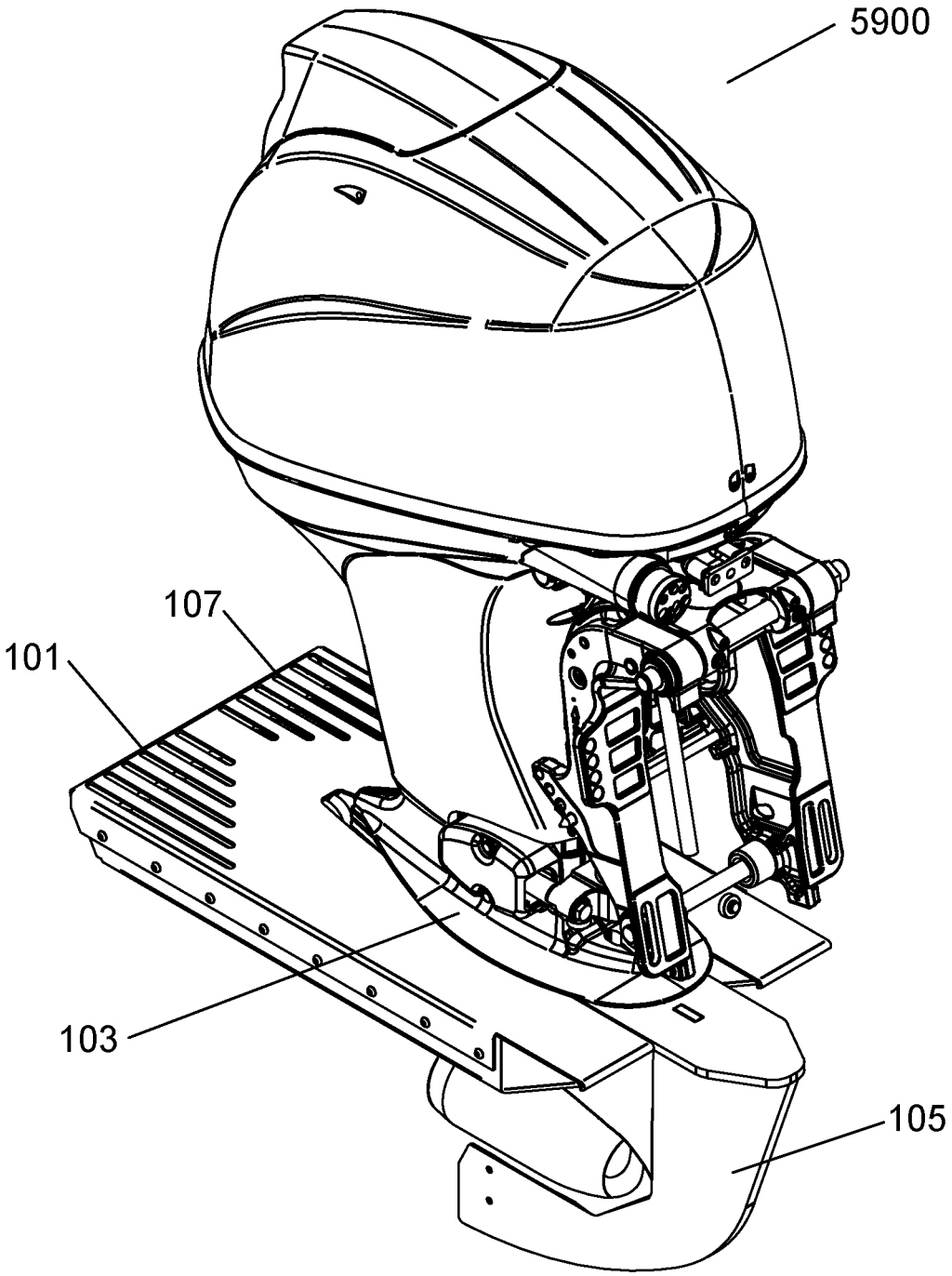
FIG. 59 is a perspective view of an outboard jet drive marine propulsion system fitted with a lower unit heat exchanger of the present invention.

FIG. 59 is a perspective view of an outboard jet drive marine propulsion system 5900 fitted with a lower unit heat exchanger 101 according to a first embodiment of the present invention.

Figure 60:
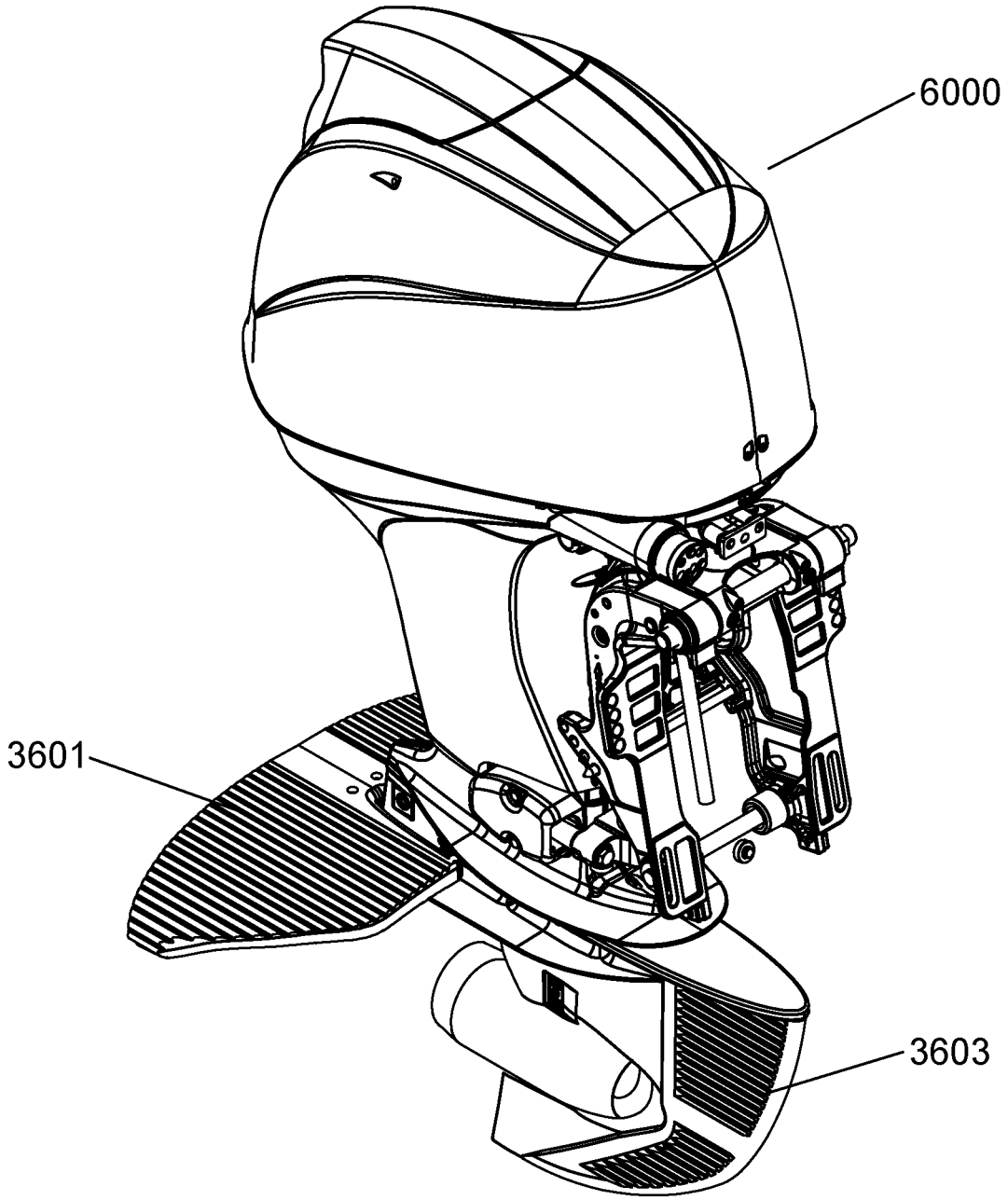
FIG. 60 is a perspective view of an outboard jet drive marine propulsion system fitted with a second embodiment of a lower unit heat exchanger of the present invention.

FIG. 60 is a perspective view of an outboard jet drive marine propulsion system 6000 fitted with a second embodiment of a lower unit heat exchanger of the present invention.

Figure 61:
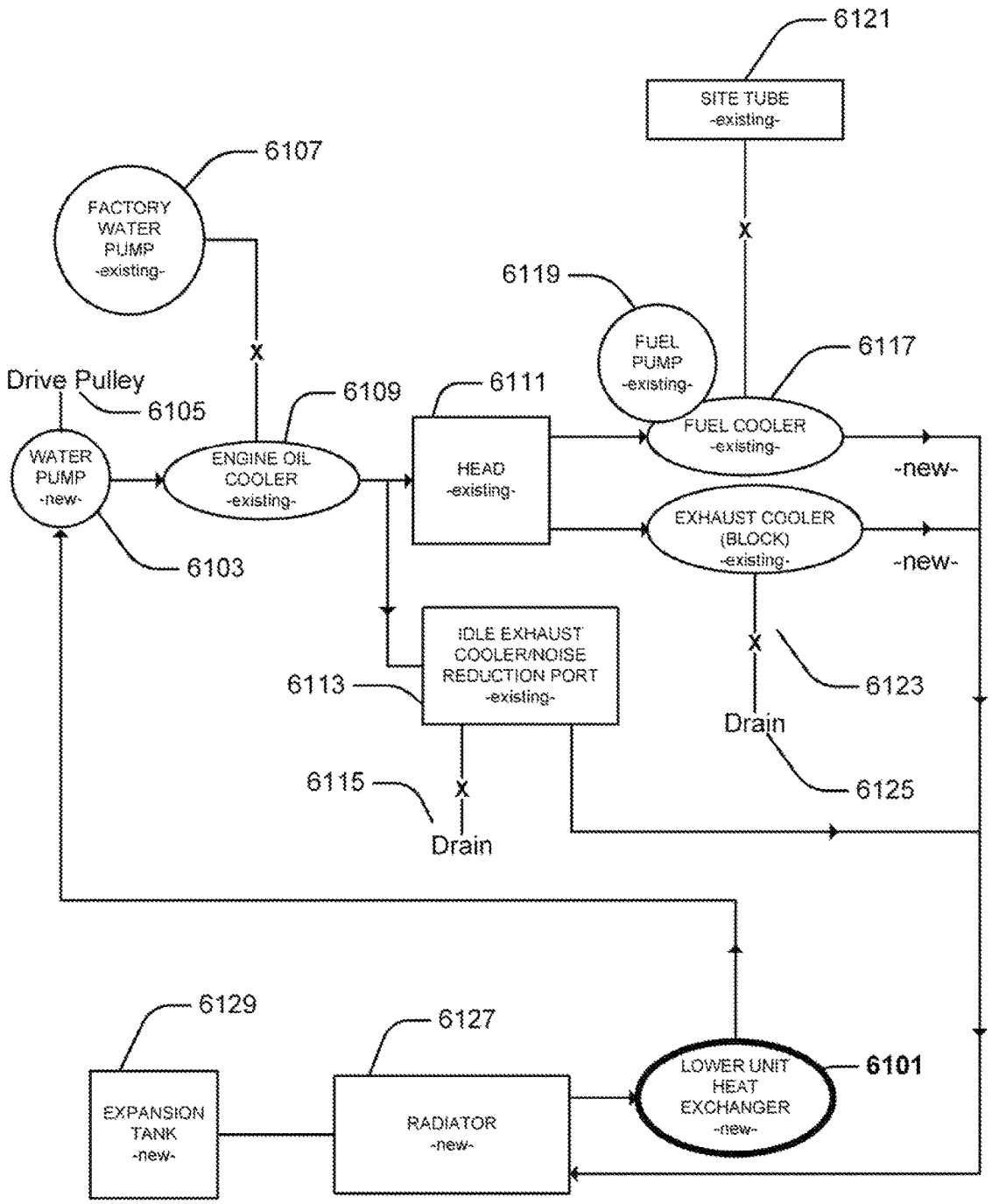
FIG. 61 is a functional block diagram of the cooling system of the present invention.

The lower unit heat exchanger connects with the overall cooling system of an outboard marine propulsion system, as previously described. As most outboard motors have open loop cooling systems where marine environment water is fed directly into the outboard motor for cooling purposes, the cooling system of the present invention will be described with an overlay or diagrammatic approach where an open loop cooling system is depicted with the modifications necessary to convert the open loop cooling system to a closed loop system. FIG. 61 is a functional block diagram of the cooling system of the present invention. Each constituent component is labeled with —existing- or —new-. Flow directions are indicated by arrow heads, and where fluid connections are broken are replaced by new connections to facilitate the closed loop modifications, they are so indicated by an "x" for a broken connection and a —new- for a newly made closed loop connection.

Following through the diagram in FIG. 61. The lower unit heat exchanger (new) 6101 is mounted to the lower unit of the outboard motor as previously described and depicted herein. In series with the lower unit heat exchanger 6101 is a radiator (new) 6127 with inflow connections as shown and outflow connections into the heat exchanger 6101. An expansion tank (new) 6129 can be seen fluidically connected to the radiator (new) 6127. In some embodiments of the present invention, the radiator and expansion tank are omitted. Leaving the heat exchanger (new) 6101, the fluid path enters a new water pump 6103 that is mechanically coupled to and driven by the existing drive pulley 6105 of the motor. The existing factory water pump 6107 is removed from the coolant loop. From the new water pump 6103, the fluid path enters the existing engine oil cooler 6109 and leaves the existing engine oil cooler 6109 to enter the existing head 6111 as well as an existing idle exhaust cooler/noise reduction port 6113 should the outboard motor be equipped with such. The existing drain 6115 for the idle exhaust cooler/noise reduction port 6113 is removed to facilitate conversion from an open loop system to a closed loop system. From the idle exhaust cooler/noise reduction port 6113 the fluid flow path goes to the new radiator 6127 and then to the new lower unit heat exchanger 6101. Two fluid paths exit the existing head 6111. The first fluid path enters the existing exhaust cooler 6123 in the block and exits to the radiator 6127 inflow via a new fluid path. The existing drain 6125 is plugged or otherwise removed to make the cooling system closed loop. The second fluid path from the existing head 6111 enters the existing fuel cooler 6117 and also exits to the radiator 6127 inflow via a new fluid path. The existing site tube 6121 for expulsion of water is plugged or otherwise removed to make a closed loop system. While these modifications are described by way of example to convert an existing open loop outboard motor cooling system to a closed loop cooling system with the lower unit heat exchanger described herein, it should be appreciated that each outboard motor manufacturer may have slightly different cooling loop topologies that should be considered in employing the closed loop lower unit heat exchanger.

It is, therefore, apparent that there has been provided, in accordance with the various objects of the present invention, an outboard marine propulsion system with a closed loop lower unit heat exchanger.

While the various objects of this invention have been described is conjunction with preferred embodiments thereof, it is evident that many alternatives, modifications, and variations will be apparent to those skilled in the art. Accordingly, it is intended to embrace all such alternatives, modifications and variations that fall within the spirit and broad scope of this specification, claims, and drawings appended herein.

What is claimed is:

1. A lower unit heat exchanger for an outboard marine propulsion system comprising:

a housing comprising an upper half and a lower half;

a cooling coil disposed within the housing;

upper cooling slots through the upper half of the housing for providing a flow of marine operating water through the cooling coil;

lower cooling slots through the lower half of the housing for providing a flow of marine operating water through the cooling coil;

an opening in the upper half of the housing configured to receive a lower unit of the outboard marine propulsion system;

an opening in the lower half of the housing configured to receive a lower unit of the outboard marine propulsion system; and a mounting tab mechanically coupled to the housing for attaching the housing to the lower unit of the outboard marine propulsion system.

2. The lower unit heat exchanger of claim 1, further comprising a front guard assembly.

3. The lower unit heat exchanger of claim 1, further comprising a second mounting tab mechanically coupled to the housing for attaching the housing to the lower unit of the outboard marine propulsion system.

4. The lower unit heat exchanger of claim 3, wherein each mounting tab is co-planar with the lower unit heat exchanger and wherein each mounting tab extends inward from the housing lower half to the housing lower half lower unit opening.

5. The lower unit heat exchanger of claim 1, further comprising cooling ports on the rear side of the housing upper half.

6. The lower unit heat exchanger of claim 1, further comprising a leading edge taper on the housing.

7. The lower unit heat exchanger of claim 6, wherein the leading edge taper is triangular.

8. The lower unit heat exchanger of claim 1, wherein the cooling coil is configured with a middle section that is shorter than each side section to accommodate the lower unit of the outboard marine propulsion system.

9. The lower unit heat exchanger of claim 1, further comprising a fluid connection at the cooling coil to allow closed loop coolant flow between the outboard marine propulsion system and the cooling coil.

10. A lower unit heat exchanger for an outboard marine propulsion system comprising:

a lower unit trailing heat exchanger comprising a first cooling foil and a second cooling foil; and a lower unit leading heat exchanger;

wherein the first cooling foil comprises a coolant port and the second cooling foil comprises a coolant port and wherein the first cooling foil coolant port and the second cooling foil coolant port have mating surfaces that are liquid tight when joined together.

11. A lower unit heat exchanger for an outboard marine propulsion system comprising:

a lower unit trailing heat exchanger comprising a first cooling foil and a second cooling foil; and a lower unit leading heat exchanger;

wherein the lower unit leading heat exchanger comprises an upper support having a lower unit opening to accommodate the lower unit of the outboard marine propulsion system.

12. A marine propulsion unit comprising:

an outboard motor; and a lower unit heat exchanger for an outboard marine propulsion system comprising:

a housing comprising an upper half and a lower half;

a cooling coil disposed within the housing;

upper cooling slots through the upper half of the housing for providing a flow of marine operating water through the cooling coil;

lower cooling slots through the lower half of the housing for providing a flow of marine operating water through the cooling coil;

an opening in the upper half of the housing configured to receive a lower unit of the outboard marine propulsion system;

an opening in the lower half of the housing configured to receive a lower unit of the outboard marine propulsion system; and a mounting tab mechanically coupled to the housing for attaching the housing to the lower unit of the outboard marine propulsion system.

13. A marine propulsion unit comprising:

an outboard motor; and a lower unit heat exchanger for an outboard marine propulsion system comprising:

a lower unit trailing heat exchanger comprising a first cooling foil and a second cooling foil; and a lower unit leading heat exchanger;

wherein the first cooling foil comprises a coolant port and the second cooling foil comprises a coolant port and wherein the first cooling foil coolant port and the second cooling foil coolant port have mating surfaces that are liquid tight when joined together.

14. A marine propulsion unit comprising:

an outboard motor; and a lower unit heat exchanger for an outboard marine propulsion system comprising:

a lower unit trailing heat exchanger comprising a first cooling foil and a second cooling foil; and a lower unit leading heat exchanger;

wherein the lower unit leading heat exchanger comprises an upper support having a lower unit opening to accommodate the lower unit of the outboard marine propulsion system.

* * * * *